US008509662B2

(12) United States Patent
Tanaka et al.

(10) Patent No.: US 8,509,662 B2
(45) Date of Patent: Aug. 13, 2013

(54) IMAGE FORMING APPARATUS AND IMAGE FORMING METHOD FOR BRINGING TRANSFER MATERIAL HELD AT INNER FACE

(75) Inventors: Shinichi Tanaka, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 315 days.

(21) Appl. No.: 13/008,288

(22) Filed: Jan. 18, 2011

(65) Prior Publication Data

US 2011/0177449 A1 Jul. 21, 2011

(30) Foreign Application Priority Data

Jan. 18, 2010 (JP) ..... 2010-007947

(51) Int. Cl.
*G03G 15/01* (2006.01)

(52) U.S. Cl.
USPC ..... 399/304

(58) Field of Classification Search
USPC ..... 399/237, 304, 303
See application file for complete search history.

(56) References Cited

U.S. PATENT DOCUMENTS

| | | | | |
|---|---|---|---|---|
| 7,558,517 | B2 * | 7/2009 | Shirafuji | 399/302 |
| 7,628,109 | B2 * | 12/2009 | Feygelman et al. | 101/409 |
| 8,145,107 | B2 * | 3/2012 | Tanaka et al. | 399/304 |
| 8,315,546 | B2 * | 11/2012 | Kamijo et al. | 399/304 |
| 8,346,141 | B2 * | 1/2013 | Takano | 399/304 |
| 8,351,832 | B2 * | 1/2013 | Kamijo et al. | 399/304 |
| 2002/0197083 | A1 * | 12/2002 | Yoshino et al. | 399/237 |
| 2004/0009012 | A1 * | 1/2004 | Kwak | 399/237 |
| 2004/0091276 | A1 * | 5/2004 | Yoshida et al. | 399/38 |
| 2010/0031837 | A1 | 2/2010 | Feygelman et al. | |
| 2010/0226699 | A1 * | 9/2010 | Kamijo et al. | 399/314 |
| 2010/0247172 | A1 * | 9/2010 | Tanaka et al. | 399/302 |
| 2010/0247175 | A1 * | 9/2010 | Tanaka | 399/313 |
| 2010/0260520 | A1 * | 10/2010 | Kamijo | 399/304 |
| 2010/0266317 | A1 * | 10/2010 | Kamijo et al. | 399/316 |
| 2010/0272472 | A1 * | 10/2010 | Gomi et al. | 399/237 |
| 2010/0272479 | A1 * | 10/2010 | Nagai et al. | 399/304 |
| 2010/0272480 | A1 * | 10/2010 | Kamijo et al. | 399/304 |
| 2010/0278550 | A1 * | 11/2010 | Chiba et al. | 399/66 |
| 2010/0303516 | A1 * | 12/2010 | Chiba et al. | 399/304 |
| 2011/0008079 | A1 * | 1/2011 | Kamijo et al. | 399/304 |

(Continued)

FOREIGN PATENT DOCUMENTS

| | | |
|---|---|---|
| JP | 2006-513883 T | 4/2006 |
| JP | 2009-036943 A | 2/2009 |

*Primary Examiner* — Walter L Lindsay, Jr.
*Assistant Examiner* — Rodney Bonnette
(74) *Attorney, Agent, or Firm* — Global IP Counselors, LLP

(57) ABSTRACT

An image forming apparatus includes a latent image carrier on which a latent image is formed, a developer carrier being in contact with the latent image carrier and configured to develop the latent image by using a liquid developer that contains toner and a carrier liquid, an image carrier belt being in contact with the latent image carrier, where the latent image carrier is configured to transfer the latent image onto an area of the image carrier belt, a transfer roller including a concave section on a circumferential surface thereof and a sheet member being configured on a part of the circumferential surface other than where the concave section is wherein the transfer roller is configured to transfer the latent image onto a transfer material, and a control unit being configured to control the area of the image carrier belt being in contact with the sheet member via the transfer material.

9 Claims, 14 Drawing Sheets

(56) References Cited

U.S. PATENT DOCUMENTS

| | | | | |
|---|---|---|---|---|
| 2011/0008080 | A1* | 1/2011 | Chiba | 399/304 |
| 2011/0044731 | A1* | 2/2011 | Nomura et al. | 399/302 |
| 2011/0058830 | A1* | 3/2011 | Saka et al. | 399/45 |
| 2011/0081172 | A1* | 4/2011 | Imamura et al. | 399/304 |
| 2011/0110680 | A1* | 5/2011 | Chiba | 399/101 |
| 2011/0116821 | A1* | 5/2011 | Tanaka et al. | 399/66 |
| 2011/0123236 | A1* | 5/2011 | Yano | 399/304 |
| 2011/0200351 | A1* | 8/2011 | Chiba et al. | 399/92 |
| 2011/0286774 | A1* | 11/2011 | Kamijo et al. | 399/318 |
| 2011/0318068 | A1* | 12/2011 | Tanaka et al. | 399/304 |
| 2012/0063820 | A1* | 3/2012 | Chiba et al. | 399/304 |

* cited by examiner

SHEET FIXING PART OF ELASTIC LAYER

SHEET TENSION PART OF ELASTIC LAYER

IMAGE FORMING APPARATUS AND IMAGE FORMING METHOD FOR BRINGING TRANSFER MATERIAL HELD AT INNER FACE

CROSS-REFERENCE TO RELATED APPLICATIONS

This application claims priority to Japanese Patent Application No. 2010-007947 filed on Jan. 18, 2010. The entire disclosure of Japanese Patent Application No. 2010-007947 is hereby incorporated herein by reference.

BACKGROUND

1. Field of the Invention

The present invention relates to an image forming apparatus configured so that there is contact between an image carrier belt and a sheet member arranged on a circumferential surface of a transfer roller having a concave section, and to an image forming method.

2. Description of the Related Art

An image forming apparatus for transferring an image formed on an image carrier onto a transfer material is disclosed in, for example, Patent Document 1. The apparatus described in Patent Document 1 is an image forming apparatus in a so-called liquid development system wherein an electrostatic latent image is made visible with a liquid developer that contains toner particles and a carrier liquid. In this apparatus, a print medium (i.e., a transfer material) is held by a holding part disposed on a part of a circumferential surface of an impression cylinder roller (equivalent to a transfer roller), and the transfer material is wound around the impression cylinder roller and passed through a nip between the impression roller and a drum-shaped intermediate transfer body (i.e., an image carrier), whereby the image is transferred onto the transfer material. According to such a configuration, the transfer material is passed through the nip while being mechanically held. Therefore, there is no possibility that the transfer material will adhere to the image carrier even when strong transfer pressure is applied in the nip.

In the image forming apparatus disclosed in Patent Document 2, an image that has been made visible by liquid development on a photoreceptor undergoes a primary transfer to an image carrier belt in the form of an endless belt (or a ring shaped belt), and the transfer material is passed through the nip between the image carrier belt and a secondary transfer roller. The image on the image carrier belt thereby undergoes a secondary transfer onto the transfer material. High transfer pressure is expected to be applied without allowing the transfer material to adhere to the image carrier belt when the transfer roller having the holding part described in Patent Document 1 is used as a secondary transfer roller in this apparatus.

Japanese Translation of PCT International Application No. 2006-513883 (e.g., FIGS. 1 and 2A) in an example of the related art (hereinafter Patent Document 1). Japanese Laid-open Patent Publication No. 2009-036943 (e.g., FIGS. 1 and 4) is another example of the related art (hereinafter Patent Document 2).

SUMMARY

Problems to be Solved by the Invention

Exchangeable sheet-shaped impression cylinder paper is wound around the surface of the impression cylinder roller (i.e., the transfer roller) disclosed in Patent Document 1. More specifically, a part of the circumferential surface of the impression cylinder is virtually cut out to form a concave section, and one end of the impression cylinder paper is tightened and supported by an impression cylinder-tightening part provided in the concave section.

According to the experiments conducted by the applicant of the invention, a configuration combining an image carrier belt with a transfer roller on which a sheet member supported in the concave section is wound around the circumferential surface clearly presents a problem in which unrecoverable deformation sometimes occurs in the image carrier belt. A natural consequence of such a deformation in the image carrier belt is the distortion of an image carried by the belt.

According to the knowledge gained by the applicant of the invention based on various experiments, the aforementioned problem of the deformation of an image carrier belt is deemed to occur as follows. Specifically, concavities and convexities (i.e., ripples) inevitably form in the sheet member wound around the circumferential surface of a transfer roller, particularly on the surface near a region where the circumferential surface meets the concave section of the transfer roller. In particular, the concavities and convexities on the surface are pronounced in the case that the sheet member is strongly tensioned in order to allow the member to withstand a high load of contact with the image carrier belt. The contact pressure of the sheet member against the image carrier belt varies with the location (i.e., non-uniform contact pressure) when the image carrier belt comes into contact with the sheet member having concavities and convexities on the surface thereof. This makes it practically impossible to perfectly match the two circumferential speeds between the sheet member and the image carrier belt that are in contact with each other, and the difference in the circumferential speeds and the pressure nonuniformity between the sheet member and the image carrier belt generate shear strain in the image carrier belt, causing the aforementioned deformation in the image carrier belt.

Several aspects of the invention provide a technique of solving the above-described problems and preventing deformation of an image carrier belt and distortion in the image caused by the deformation of the image carrier belt in the image forming apparatus and the image forming method.

To solve the aforementioned problem, an image forming apparatus is provided. The image forming apparatus includes a latent image carrier, a developer carrier, an image carrier belt, a transfer roller, and a control unit. A latent image is formed on the latent image carrier. The developer carrier is in contact with the latent image carrier and is configured to develop the latent image formed on the latent image carrier by using a liquid developer that contains toner and a carrier liquid. The image carrier belt is in contact with the latent image carrier. The latent image carrier is configured to transfer the latent image onto an area of the image carrier belt. The transfer roller includes a concave section on a circumferential surface thereof and a sheet member being configured on a part of the circumferential surface other than where the concave section is. The transfer roller is configured to transfer the latent image onto a transfer material by rendering the image carrier belt, which holds the latent image, to be in contact with the transfer material supported by the sheet member. The control unit being configured to control the area of the image carrier belt being in contact with the sheet member via the transfer material.

DETAILED DESCRIPTION OF EXEMPLARY EMBODIMENTS

Figure 1:
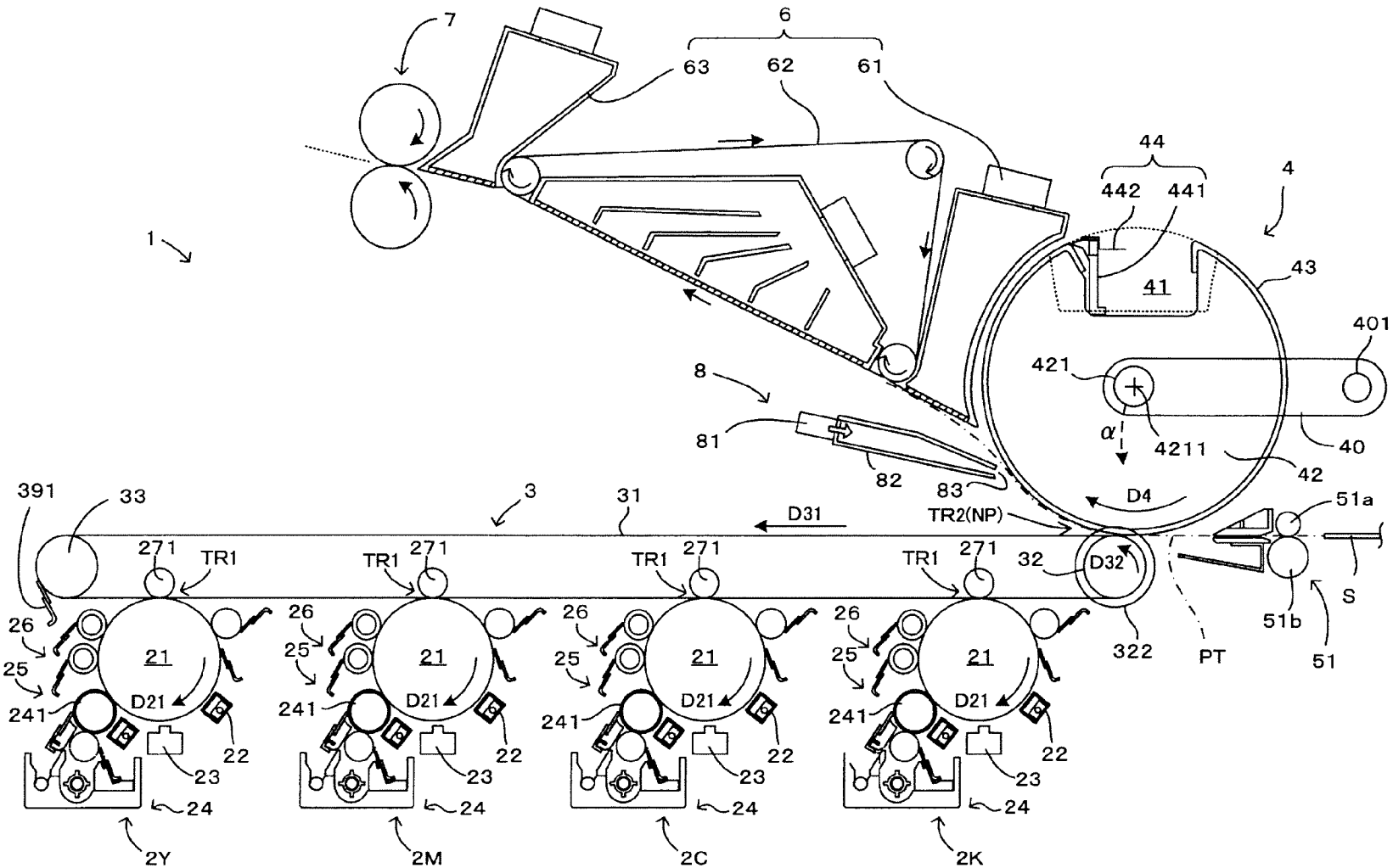
FIG. 1 is a view showing a first embodiment of an image forming apparatus according to the invention.
Figure 2:
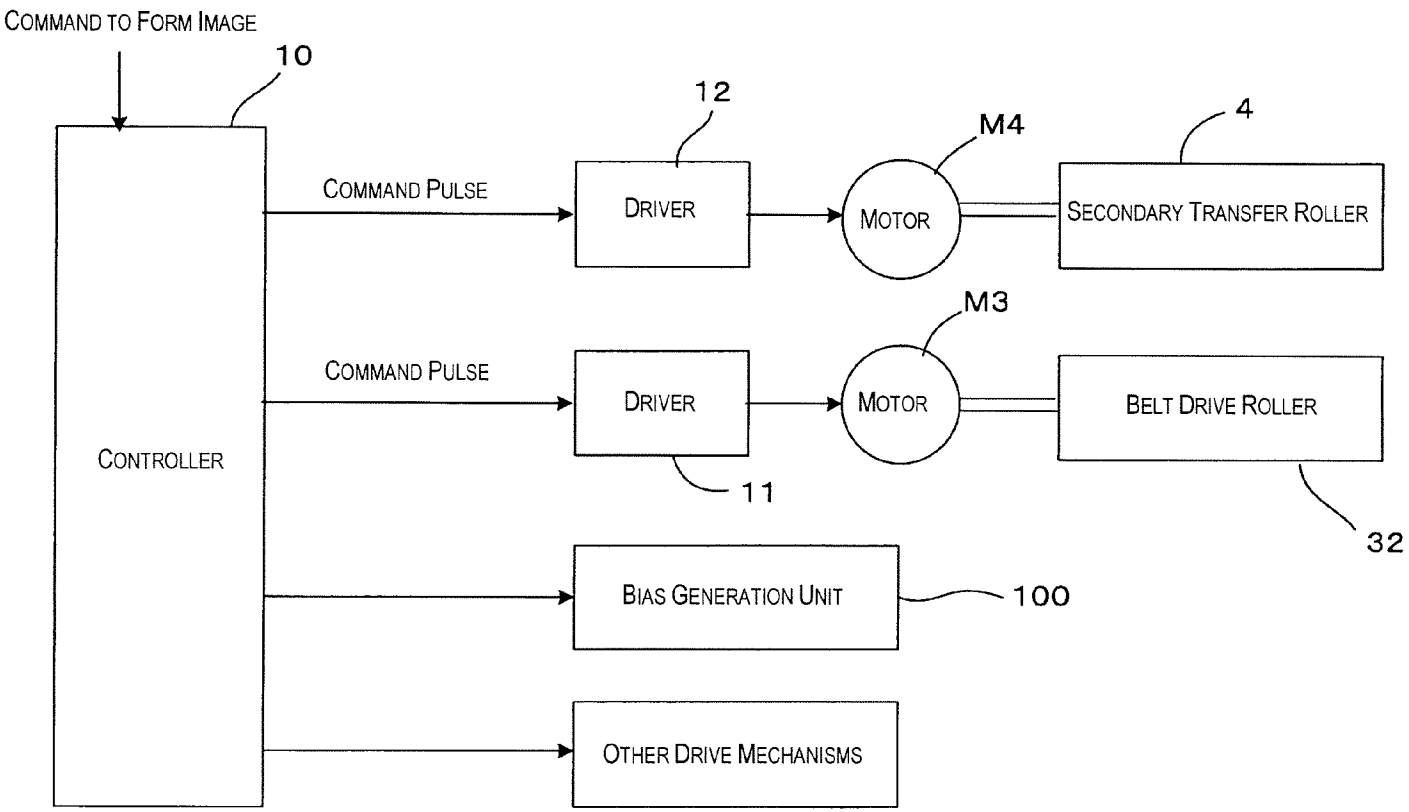
FIG. 2 is a block diagram showing an electrical configuration of the apparatus shown in FIG. 1.

FIG. 1 is a view showing a first embodiment of an image forming apparatus according to the invention. FIG. 2 is a block diagram showing an electrical configuration of the apparatus shown in FIG. 1. An image forming apparatus 1 is provided with four image-forming stations 2Y (for yellow), 2M (for magenta), 2C (for cyan), and 2K (for black) each forming a mutually different color image. The image forming apparatus 1 can selectively execute a color mode for forming a color image by superimposing the toners of four colors yellow (Y), magenta (M), cyan (C), and black (K), and in a monochrome mode for forming a monochrome image using only the black (K) toner. In the image forming apparatus, a command to form an image is issued from an external apparatus such as a host computer to a controller 10 including a CPU, a memory, and the like. At this time, the controller 10 controls each respective station of the image forming apparatus to execute a prescribed image forming operation, and forms an image corresponding to the command to form an image on a sheet-shaped transfer material S such as copy paper, transfer paper, printed form, transparent sheet used for overhead projectors (OHP), or the like.

Each image-forming station 2Y, 2M, 2C, and 2K is equipped with a photoreceptor drum 21 for forming a toner image of each respective color on the surface thereof. Each of the photoreceptor drums 21 is arranged so that its rotation axis is parallel or approximately parallel to the primary scanning direction (i.e., a direction perpendicular to the sheet surface shown in FIG. 1), and is rotated at a predetermined speed in the direction of arrow D21, as shown in FIG. 1.

The following components are arranged in the indicated sequence along the rotation direction D21 (clockwise in FIG. 1) of each of the photoreceptor drums 21 in the vicinity of each of the photoreceptor drums 21: a charger 22 that is a corona charger for charging the surface of the corresponding photoreceptor drum 21 at a predetermined electrostatic potential, an exposure unit 23 for forming an electrostatic latent image by exposing the surface of the photoreceptor drum 21 in response to an image signal, a developing unit 24 for developing the latent image as a toner image, a first squeeze unit 25, a second squeeze unit 26, a primary transfer unit for performing a primary transfer of the toner image to an intermediate transfer belt 31 of a transfer unit 3, a cleaning unit for cleaning the surface of the photoreceptor drum 21 after the transfer, and a cleaner blade.

The charger 22 is positioned so as not to be in contact with the surface of the photoreceptor drum 21. The charger 22 may use a conventional well-known corona charger. When a scorotron charger is used for the corona charger 22, a positive wire current will flow in a charging wire of the scorotron charger, and a grid charge bias that is a direct current (DC) is applied to a grid. When the photoreceptor drum 21 is charged by corona discharge by the charger 22, the electrostatic potential of the surface of photoreceptor drum 21 is set to be substantially uniform.

The exposure unit 23 exposes the surface of the photoreceptor drum 21 using an optical beam in response to the image signal supplied from the external apparatus so as to form the electrostatic latent image corresponding to the image signal. The exposure unit 23 may be constituted by, for example, a unit that scans an optical beam from a semiconductor laser using a polygon mirror, or by a line head in which light emission elements are arrayed in the primary scanning direction.

The toner is applied from a developing roller 241 provided to each of the developing units 24 to the electrostatic latent image formed in the aforementioned manner, and the latent image is developed by the toner. In the developing unit 23 of the image forming apparatus 1, a toner image is formed by using a liquid developer in which the toner is dispersed in a carrier liquid in a weight ratio of about 20%. The liquid developer used in the present embodiment is a nonvolatile liquid developer having high density and high viscosity, and being nonvolatile at ambient temperature, instead of a conventionally generally used volatile liquid developer having low density (1 to 2 wt %) using Isopar (trademark registered by Exxon Corporation) and being volatile at ambient temperature. In other words, the liquid developer used in the present embodiment is produced by adding solid particles having an average particle size of 1 μm, in which colorant is dispersed in a thermoplastic resin, to a solvent such as organic solvent, silicone oil, mineral oil, or cooking oil, along with a dispersant. This liquid developer is a high viscosity liquid developer (i.e., a liquid developer having a viscoelasticity of about 30 to 300 mPa·s at the shear rate of 1,000 (1/S) at 25° C. as determined using the HAAKE Rheo Stress RS600) having a concentration of 20% in terms of toner solids.

The first squeeze unit 25 is arranged downstream of the developing position in the rotation direction D21 of the photoreceptor drum 21, and the second squeeze unit 26 is arranged downstream of the first squeeze unit 25. The squeeze units 25 and 26 are each equipped with squeeze rollers. Each squeeze roller is brought into contact with the surface of the photoreceptor drum 21 to remove surplus carrier liquid and background toner (i.e., toner particles scattered in the background area of an image). In the present embodiment, while the surplus carrier liquid and background toner are removed by the squeeze units 25 and 26, the number and arrangement of the squeeze units are discretionary; for example, a single squeeze unit may be provided.

The toner image passing through the squeeze units 25 and 26 undergoes a primary transfer to the intermediate transfer belt 31 by the primary transfer unit. The intermediate transfer belt 31 is tensioned between a set of belt transport rollers 32 and 33 arranged apart from each other, and circumferentially rotated in the predetermined direction D31 by a roller drive utilizing a belt drive motor M3. More specifically, the right roller 32, shown in FIG. 1, of the belt transport rollers 32 and 33 is the drive roller, and the belt drive motor M3 is mechanically connected to the drive roller 32. In the present embodiment, a driver 11 is provided for driving the drive motor M3, and the driver 11 outputs a drive signal in response to a command pulse issued from the controller 10 to the motor M3 so as to perform positioning control. The drive roller (i.e., belt transport roller) 32 is thereby caused to rotate in the arrow direction D32 shown in FIG. 1 at a circumferential velocity corresponding to the command pulse, and the surface of the intermediate transfer belt 31 moves in a loop in the direction D31 at a constant speed.

The primary transfer unit has a backup roller 271. The backup roller 271 is arranged so as to face the photoreceptor drum 21 in the primary transfer position TR1 with the intermediate transfer belt 31 sandwiched therein so as to press the intermediate transfer belt 31 onto the photoreceptor drum 21. The toner image on photoreceptor drum 21 is thereby transferred to the intermediate transfer belt 31. The toner image is then transferred by the transfer unit of each color, and the toner image of each color on the photoreceptor drum 21 is thereby superimposed in sequence to form a full-color toner image.

The toner image transferred to the intermediate transfer belt 31 is thus transferred to the secondary transfer position TR2. At the secondary transfer position TR2, the secondary transfer roller 4 is disposed in a facing arrangement across the intermediate transfer belt 31 wound around the drive roller 32 of the transfer unit 3. As shown in FIG. 2, the secondary transfer roller 4 is rotationally driven by a secondary transfer roller drive motor M4. The secondary transfer drive motor M4 is controllably driven by a drive signal output from a driver 12 in response to a command pulse issued from the controller 10. At the secondary transfer position TR2, the single-color or multiple-color toner image formed on the intermediate transfer belt 31 is subjected to a secondary transfer to the transfer material S transported along a transport path PT from gate rollers 51 (i.e., a set of rollers 51*a* and 52*b*).

The transfer material S with the toner image secondarily transferred thereon is transported to a transport mechanism 6 from the secondary transfer roller 4 along the transport path PT. The transport mechanism 6 is equipped with a first suction unit 61, a transfer material transport unit 62, and a second suction unit 63, sequentially disposed along the transport path PT, and these units operate together in order to transport the transfer material S to a fuser unit 7.

A blower unit 8 is also provided in the present embodiment so as to face the secondary transfer roller 4 between the transfer position TR2 and first suction unit 61 in order to securely feed the secondarily transferred transfer material S, provided with the toner image as a result of a secondary transfer, to the first suction unit 61 and to prevent contamination of the image. The air generated in accompaniment with the operation of an airflow generation unit 81 is exhausted by the blower unit 8 from the opening 83 of a housing 82 as indicated by the solid-white arrow, and the air is thereby blown between the intermediate transfer belt 31 and the leading edge of the transfer material S, which is released from being held by a holding unit 44 of the secondary transfer roller 4 and is extended in a direction away from the secondary transfer roller 4 by a protruding finger (not shown). Thus, the leading edge of the transfer material S is fed toward the first suction unit 61. By blowing the air toward the transfer material S, it is possible to prevent contamination of the image by the trailing edge of the transfer material S in contact with the intermediate transfer belt 31, or other parts, when the trailing edge is ejected from the secondary transfer position TR2. If the transfer material S has a small elastic recovery force and readily buckles, the blowing of air by the blower unit 8 may be stopped.

The fuser unit 7 is equipped downstream of the transport path PT, in other words, on the opposite side of the secondary transfer roller 4 (i.e., the left, near side in FIG. 1). Heat, pressure, and the like are applied to the toner image transferred to the transfer material S. And the toner image is fused onto the transfer material S.

A cleaner blade 391 is brought into contact with the intermediate transfer belt 31, with the toner image secondarily transferred thereto. More specifically, the cleaner blade 391 is brought via the intermediate transfer belt 31 into contact with the roller 33 on which the intermediate transfer belt 31 is wound, downstream of the secondary transfer position TR2 in the transport direction D31 of the intermediate transfer belt 31. The cleaner blade 391 removes residual deposits such as toner and carrier liquid remaining on the surface of the intermediate transfer belt 31 after the secondary transfer.

As shown in FIG. 2, the apparatus 1 also includes a bias generation unit 100 for generating a bias voltage to be applied to each individual unit of the apparatus 1, and a variety of drive mechanisms for driving the respective units of the apparatus 1 other than the aforementioned secondary transfer roller 4 and belt drive roller 32, wherein the operations are controlled by the controller 10.

In the present embodiment, the toner image is formed in a wet development system using a liquid developer to form a toner image. Therefore, the secondary transfer roller 4 having the holding part is used in order to apply a sufficient transfer pressure to the transfer material S while preventing the transfer material S from adhering to the intermediate transfer belt 31. The structure of the secondary transfer roller 4 will now be described in detail below with reference to FIGS. 1, 2 and 3 through 5.

Figure 3:
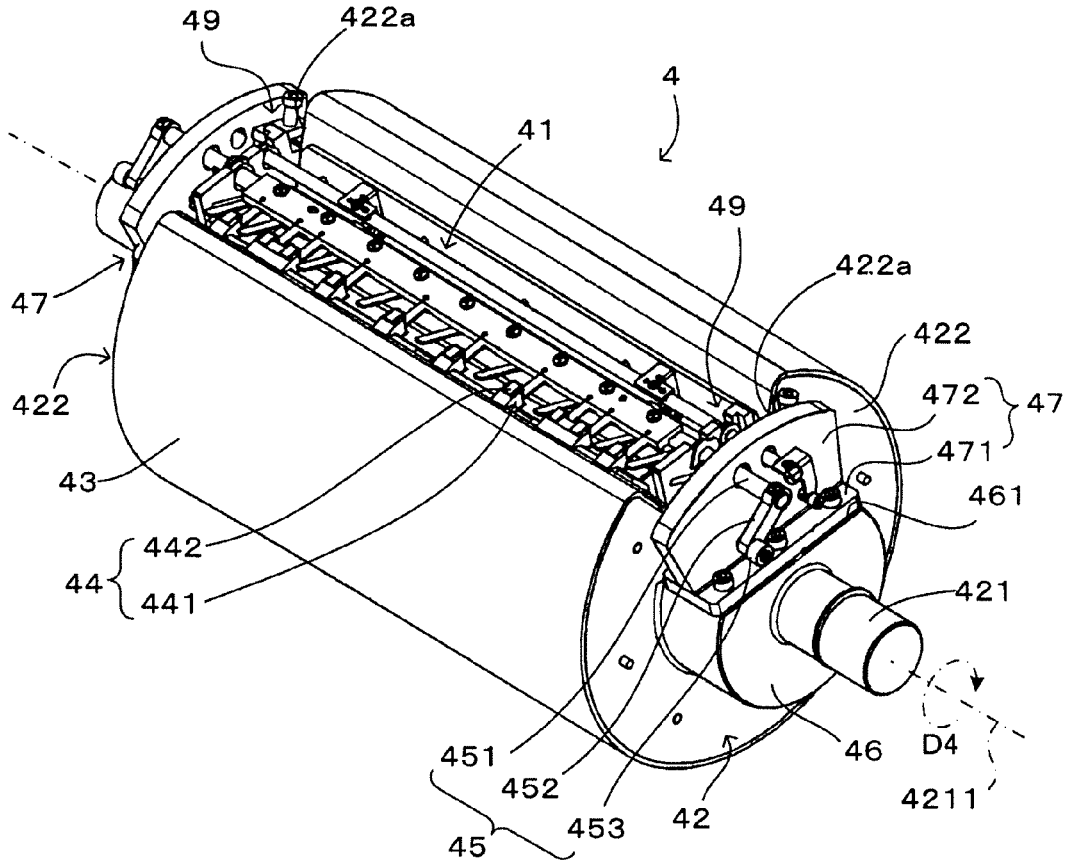
FIG. 3 is a perspective view showing the overall configuration of a secondary transfer roller.
Figure 4A:
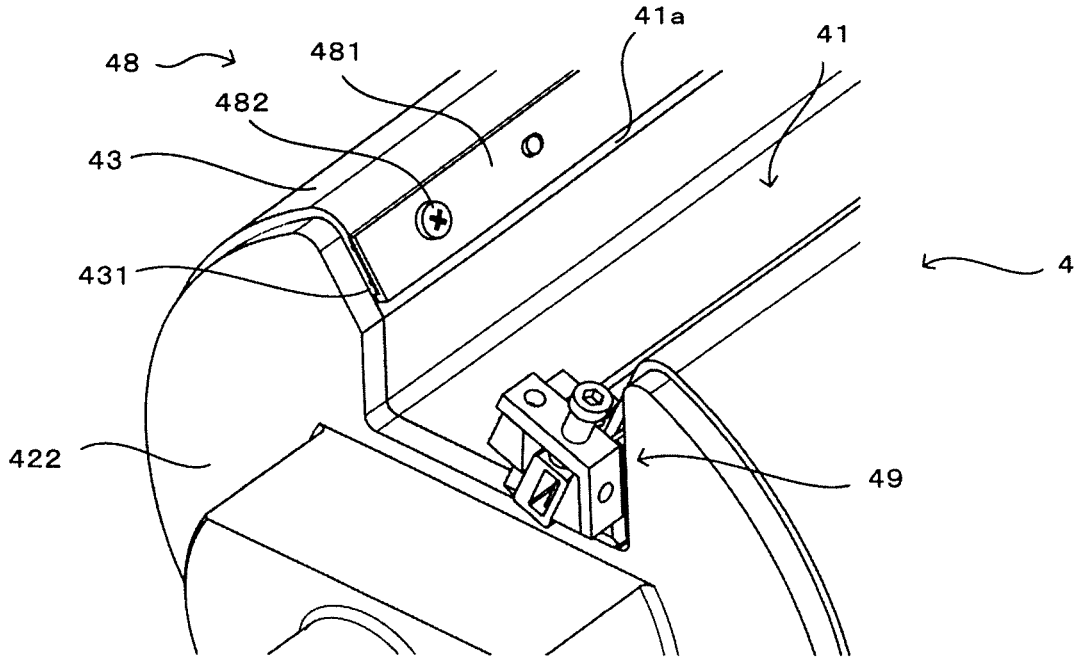
FIG. 4 is a partial enlarged view of the secondary transfer roller shown in FIG. 3.
Figure 4B:
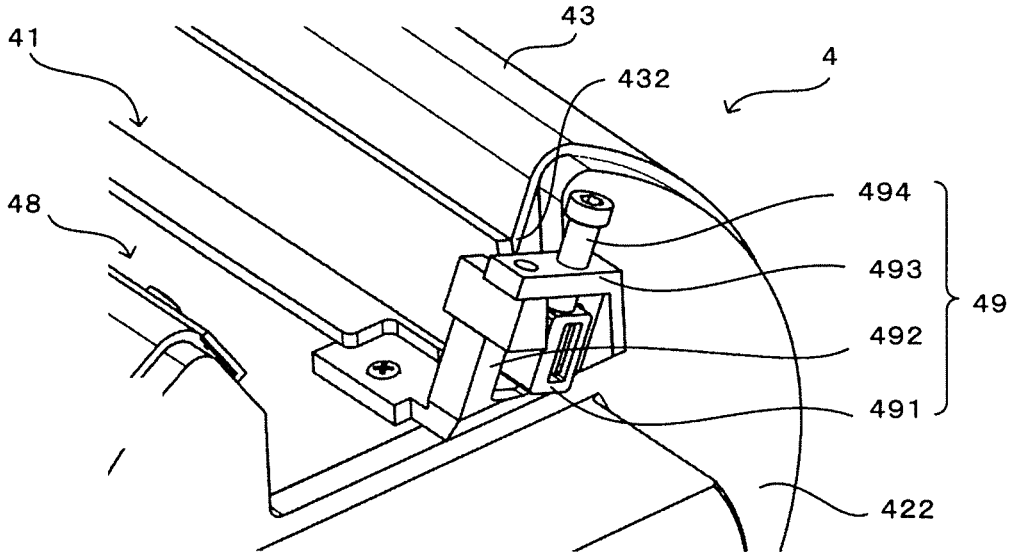
Figure 5:
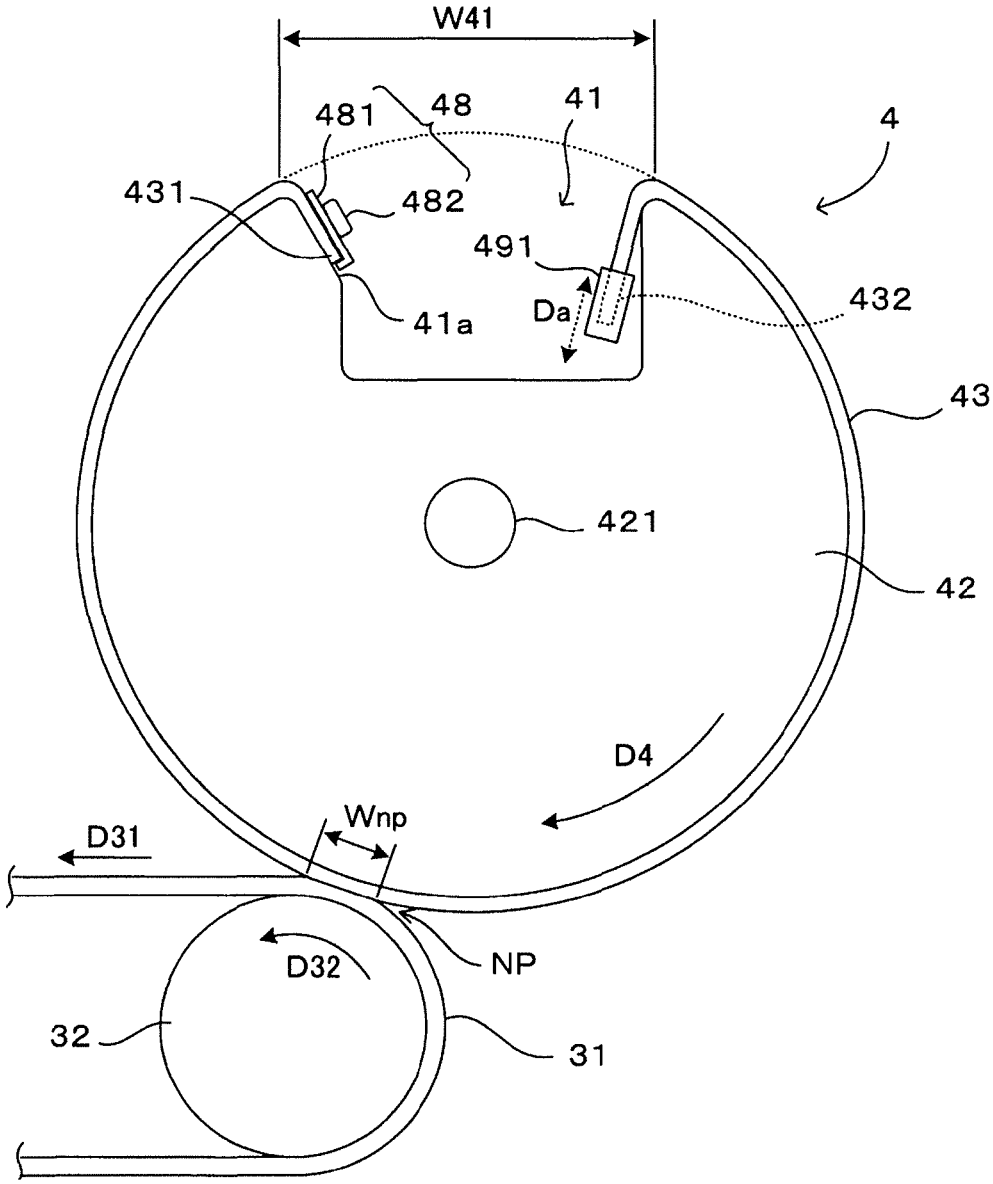
FIG. 5 is a side view showing a state where an elastic layer of the secondary roller is tensioned.

FIG. 3 is a perspective view showing the overall configuration of a secondary transfer roller. FIG. 4 is a partial enlarged view of the secondary transfer roller shown in FIG. 3. FIG. 5 is a side view showing a state where an elastic layer of the secondary roller is tensioned. More specifically, FIG. 4A shows a fixing part for fixing one end of the elastic layer, and FIG. 4B shows a tension part for stretching the elastic layer. FIGS. 4 and 5 show a state in which a contact member and a holding part (described below) are removed in order to clearly show the configuration of the fixing part and the tension part.

As shown in FIGS. 1 and 3, the secondary transfer roller 4 has a roller substrate 42 equipped with a concave section 41 formed by virtually cutting away a part of the outer circumferential surface of a cylinder. The roller substrate 42 is equipped with a rotation shaft 421 extending in a direction perpendicular to the plane of FIG. 1. The rotation shaft 421 is equipped so as to be rotatable around a shaft center 4211 relative to a support arm 40 that is supported on an apparatus housing (not shown). The support arm 40 is supported so as to be pivotal around a support shaft 401 relative to the apparatus housing, and is urged counterclockwise in FIG. 1 using urging means (not shown). Therefore, the secondary transfer roller 4 is urged in the direction of arrow $\alpha$, and urged toward the intermediate transfer belt 31 that is wound around the belt drive roller 32. The secondary transfer roller 4 is thereby pressed against the intermediate transfer belt 31 by a predetermined load (e.g., 60 kgf).

Side panels 422 and 422 are attached respectively to both ends of the rotation shaft 421. More specifically, the side panels 422 and 422 each have a shape in which a notched part 422*a* is cut out in a disc-shaped metallic plate. As shown in FIG. 3, the notched parts 422*a* and 422*a* are attached to the rotation shaft 421 facing each other at a distance that is slightly greater than the width of an elastic sheet. The roller substrate 42 is thus formed in an overall drum shape, with the concave section 41 extending parallel or approximately parallel to the rotation shaft 421 on a part of the outer circumferential surface of the roller substrate 42.

At either end of the secondary transfer roller 4, a support member 46 is attached to the outer side face of the side panel 422, and the support member 46 is integrally rotatable with the roller substrates 42. A flat area 461 is formed on the support member 46 corresponding to concave section 41. A transfer roller-side contact member 47 is attached to the flat area 461. On the transfer roller-side contact member 47, a base part 471 is attached to the support member 46, a contact part 472 is disposed so as to extend from the base part 471 in a normal direction of the flat area 461, and the edge of the contact part 472 is disposed so as to extend up to the edge of the opening of the concave section 41. In other words, when viewing the contact member 47 from the direction of the rotation shaft 421, the contact member 47 is mounted so that the contact member 47 closes the concave section 41 and so that the circumferential end of the contact part 472 is partially overlapped with the circumference (i.e., the elastic layer 43) of the secondary transfer roller 4.

At either end of the drive roller 32 having the intermediate transfer belt 31 wound thereon, a bearing 322 (see FIG. 1) is provided so as to be coaxial with the drive roller 32 and rotatable independently from the drive roller 32. The outer circumferential surface of the contact member 47 and the outer circumferential surface of the bearing 322 come into contact with each other when the contact member 47 of the secondary transfer roller 4 faces the drive roller 32.

An elastic sheet made of an elastic material, such as elastomer, resin, or the like, is wound on the surface area of the outer circumferential surface of the roller substrate 42; i.e., a surface area other than the area corresponding to the inside of the concave section 41 of the metal plate surface. The elastic layer 43 is formed by the aforementioned elastic sheet. The present embodiment is configured so that the elastic sheet (elastic layer 43) can be replaced as a measure to repair deterioration over time, such as wear and damage of the elastic sheet. Specifically, the elastic sheet is not affixed to the secondary transfer roller 4. More specifically, one inner face 41*a* of the concave section 41 is equipped with a sheet fixing part 48, as shown in FIGS. 4*a* and 5. The sheet fixing part 48 has a hold-down plate 481. The hold-down plate 481 is fastened to the secondary transfer roller 4 by screws 482 while one end 431 of the elastic sheet is sandwiched between the hold-down plate 481 and secondary transfer roller 4. One end 431 of the elastic sheet is thereby fixed to the secondary transfer roller 4. The other end 432 of the elastic sheet is then attached to the secondary transfer roller 4 while being tensioned in a direction opposite from the rotation direction D4 by a sheet tension part 49 in a state where the central part of the elastic sheet is wound along the outer circumferential surface of the secondary transfer roller 4.

A sheet tension part 49 is arranged at each end of the elastic sheet in the width direction (a direction parallel to a shaft direction of the rotation shaft 421), as shown in FIG. 3. As shown in FIGS. 4B and 5, at each sheet tension part 49, a plate 491 attached to the other end 432 of the elastic sheet is inserted into a slide part of a side panel 492, and a fastening screw 494 is fastened with a predetermined torque after attaching a stop plate 493. Thereby the elastic sheet is wound around the outer circumferential surface of the secondary transfer roller 4 without any slack, and the elastic layer 43 is now formed. Specifically, the one end 431 of the elastic sheet fixed at the sheet fixing part 48 constitutes the winding start, while the other end 432 constitutes the winding end. The elastic layer 43 is arranged opposite from the intermediate transfer belt 31 wound around the drive roller 32, and a nip is thereby formed.

In the present embodiment, the opening length (i.e., the opening width) W41 of the concave section 41 along the rotation direction D4 of the roller substrate 42 is about 105 mm. The elastic layer 43 is pressed toward the intermediate transfer belt 31 to form a transfer nip NP when the elastic layer 43, which is formed in the area other than the concave section 41 of the outer circumferential surface of the secondary transfer roller 4, is positioned opposite from the intermediate transfer belt 31. The length (i.e., the transfer nip width) Wnp of the transfer nip NP along the rotation direction D4 of the roller substrate 42 is about 11 mm and satisfies following relationship:

(Opening width *W*41 of the concave section 41)>
(Transfer nip width *Wnp* at the transfer nip *NP*)

Therefore, the transfer nip NP is temporarily lost in a state where the concave section 41 of the secondary transfer roller 4 faces the intermediate transfer belt 31.

The length of the elastic layer 43 along the rotation direction D4 of the roller substrate 42 is set at about 495 mm. The setup is intended to allow the winding of a transfer material S having the largest size that can be used in the apparatus 1. Specifically, the length of the elastic layer 43 is determined to be greater than the length of a transfer material S whose length along the rotation direction D4 of the roller substrate 42 is the maximum among the available transfer materials S.

A holding part 44 for holding the transfer material S is equipped at a position close to the one end 431 on the winding start of the elastic layer 43 inside of the concave section 41. The holding part 44 has a gripper support member 441 provided vertically from the bottom of the concave section 41 to the outer circumferential surface of the roller substrate 42, and also has a gripper support member 442 supported so as to be into contact with and separated from the top end of the gripper support member 441. By the action of an opening/closing mechanism 45 described below, the tip end of the gripper member 442 is separated from the top end of the gripper support member 441 to prepare for gripping and releasing the transfer material S. The transfer material S is held by the movement of the tip end of the gripper support member 442 to the tip end of the support member 441.

Figure 6:
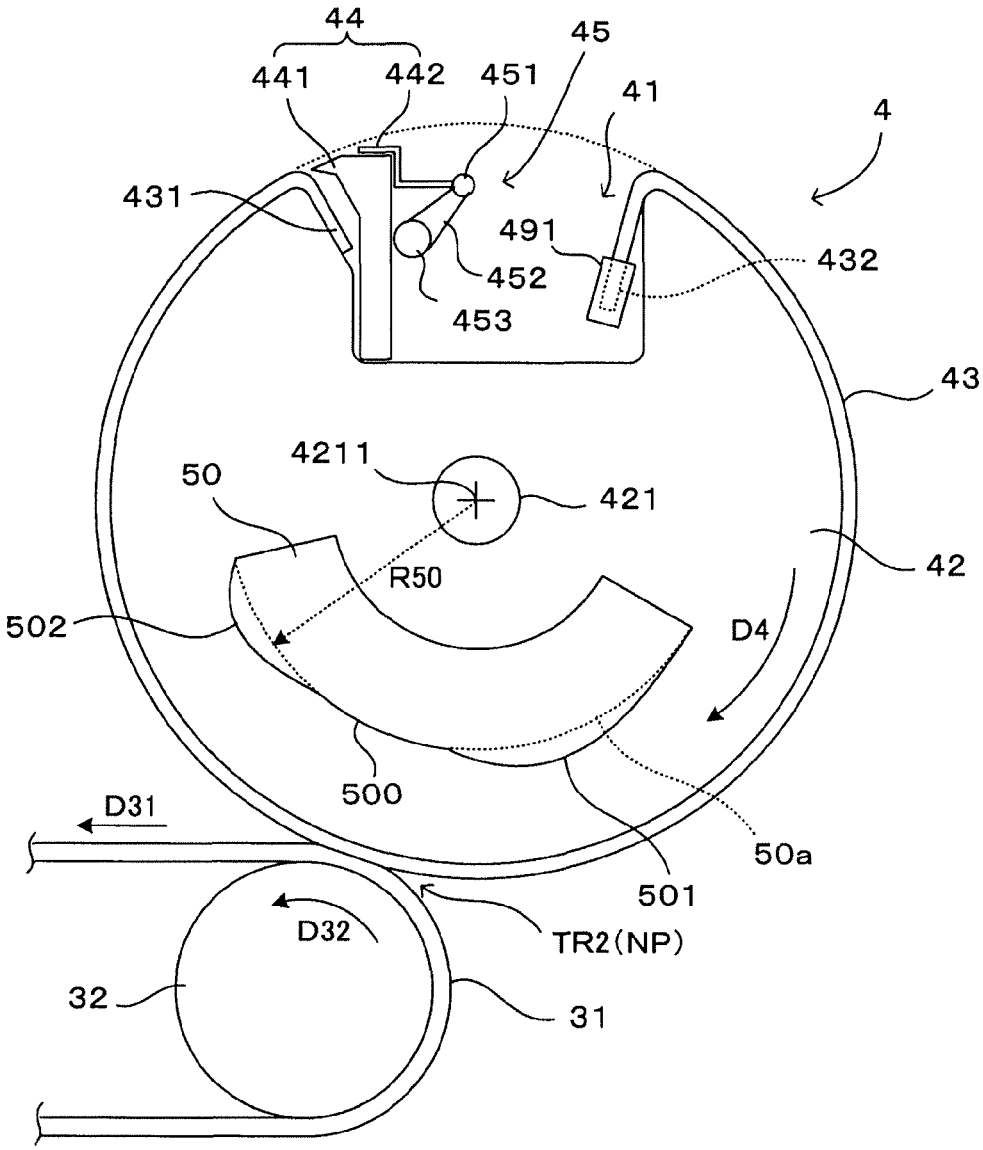
FIG. 6 is a view showing an opening/closing mechanism of a holding part.

FIG. 6 is a view showing the opening/closing mechanism of the holding part. FIGS. 7 and 8 are views showing the relationship between the rotation phase and the opening/closing state of the holding part of the secondary transfer roller. FIGS. 7 and 8 schematically show the change in the opening/closing state of the holding part 44 caused by the rotation of the secondary transfer roller 4, and the manner in which the transfer material S is held and released in association with the change. In FIGS. 6 through 8, the contact member 47, the sheet fixing part 48, the sheet tension unit 49, and other parts unrelated to the operation of the holding parts are not shown in order to clearly show the holding mechanism.

As shown in FIGS. 3 and 6, the gripper member 442 is attached to a support shaft 451 of a crank arm 452 configured so as to be rotatable around the support shaft 451. A cam follower 453 is equipped at the tip end of the crank arm 452.

Although urging members are not shown, the gripper member 442 is urged in a direction in which the tip end of the gripper member 442 is brought into contact with the gripper support member 441 (i.e., counterclockwise around the support shaft 451 in FIG. 6). In other words, in a state where external force is not applied, the holding part 44 is maintained in a closed state. The support shaft 451, crank arm 452, cam follower 453, and other components integrally constitute the opening/closing mechanism 45.

A cam member 50 is fixed at a position near the axial edges of the secondary transfer roller 4 and drive roller 32 on the inside surface of the apparatus housing (not shown). The outer circumferential surface 500 of the cam member 50 is approximately in line with a circular arc 50*a* in a radius R50 around the rotational center 4211 of the secondary transfer roller 4. However, the outer circumferential surface 500 is provided with protrusions 501 and 502, which extend beyond the aforementioned circumferential surface 500. The outer circumferential surface of the cam member 50 thus formed and the outer circumferential surface of the cam follower 453 disposed on the opening/closing mechanism 45 make intermittent contact with each other in association with the rotation of the secondary transfer roller 4. The cam follower 453 moves following the form of the outer circumferential surface of the cam member 50, causing the crank arm 452 to turn and the tip of the gripper member 442 to open or close in relation to the gripper support member 441.

Specifically, in the present embodiment, the holding part 44 automatically opens or closes synchronously with the rotation phase of the secondary transfer roller 4. As shown in FIG. 7, the cam follower 453 is moved away from the cam member 50, with the holding part 44 maintained in a closed state, by the action of the urging member (not shown) when the concave section 41 of the secondary transfer roller 4 is positioned far apart from the secondary transfer position TR2.

Figure 7A:
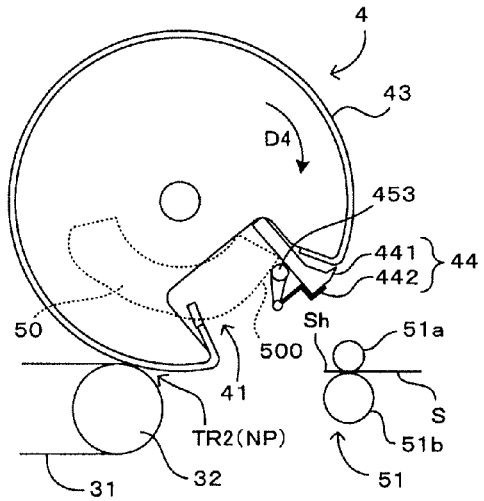
FIG. 7 is a first diagram showing the relationship between the rotation phase and the opening/closing state of the holding part of the secondary transfer roller.
Figure 7B:
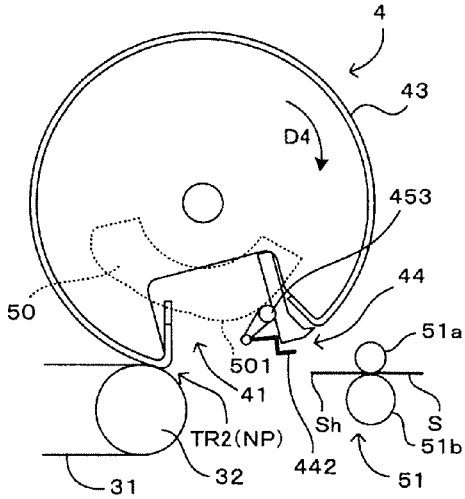

As the rotation of the secondary transfer roller 4 progresses in the direction D4, the concave section 41 approaches the secondary transfer position TR2 as shown in FIG. 7A, and the cam follower 453 begins to make contact with the outer circumferential surface 500 of the cam member 50. As the aforementioned rotation progresses, the cam follower 453 moves over the first protrusion 501 of the outer circumferential surface 500 of the cam member 50, causing the crank arm 452 to rotate around the support shaft 451 and the tip of the gripper member 442 to begin to move away from the gripper support member 441, as shown in FIG. 7B. In an actual image forming operation, the gate roller 51 begins to drive in response to the rotation of the secondary transfer roller 4, and the transfer material S is transported toward the secondary transfer position TR2. The symbol Sh indicates the leading edge of the transfer material S in the direction in which the transfer material is transported.

Figure 7C:
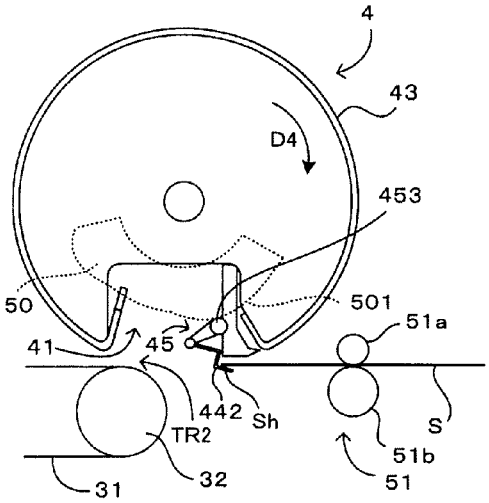

When the rotation progresses further and the concave section 41 is facing the secondary transfer position TR2, the nip is temporarily lost, as shown in FIG. 7C. The holding part 44 is further opened to accept the leading edge Sh of the transfer material S. Specifically, the leading edge Sh of the transfer material S is inserted between the opened gripper member 442 and the gripper support member 441. At this point, controlling the leading edge Sh of the transfer material S so as to collide with the gripper member 442 makes it possible to accurately establish the positional relationship between the rotation phase of the secondary transfer roller 4 and the leading edge Sh of the transfer material S with good repeatability. It is also possible to correct any skew in the transfer material S.

Figure 7D:
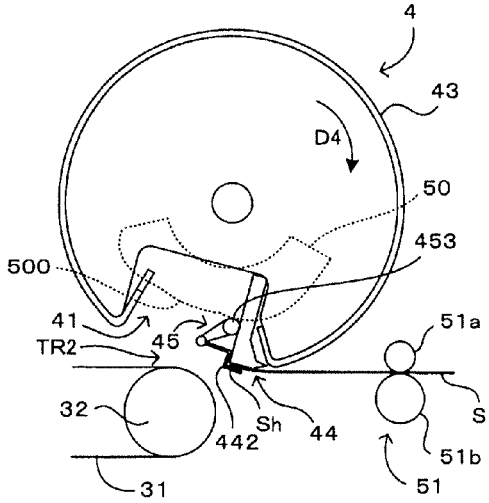

Once this state is reached, the outer circumferential surface 500 of the cam member 50 assumes a gradually receding shape. Therefore, the opened portion of the holding part 44 becomes smaller as the rotation of the secondary transfer roller 4 further progresses. Eventually, the holding part 44 is completely closed, as shown in FIG. 7D, to complete the operation of holding the transfer material S. Thus the transfer material S whose leading edge Sh is held in place is fed to the secondary transfer position TR2.

Figure 8A:
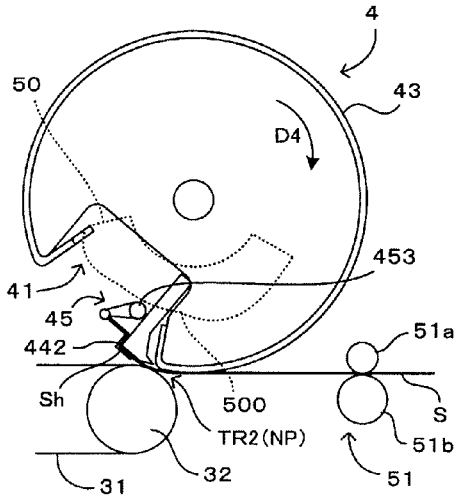
FIG. 8 is a second diagram showing the relationship between the rotation phase and the opening/closing state of the holding part of the secondary transfer roller.

Subsequently, the concave section 41 passes the secondary transfer position TR2, causing the elastic layer 43 of the secondary transfer roller 4 to come into contact with the intermediate transfer belt 31 via the transfer material S, as shown in FIG. 8A. Specifically, the transfer material S is caught in the nip between the elastic layer 43 of the secondary transfer roller 4 and the intermediate transfer belt 31. The leading edge Sh of the transfer material S is continuously held by the holding part 44 until at least the leading edge Sh of the transfer material S completely passes the nip NP. Therefore, the transfer material S is prevented from adhering to the intermediate transfer belt 31.

Figure 8B:
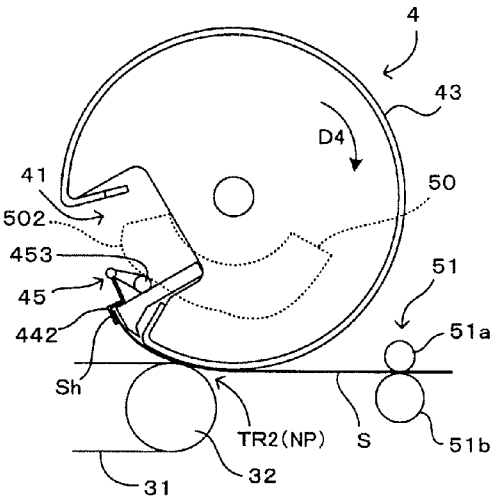
Figure 8C:
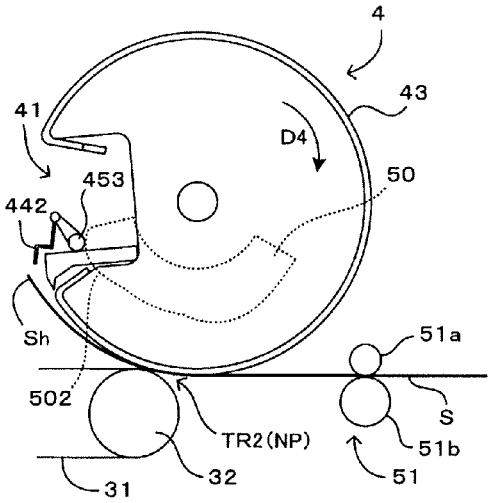
Figure 8D:
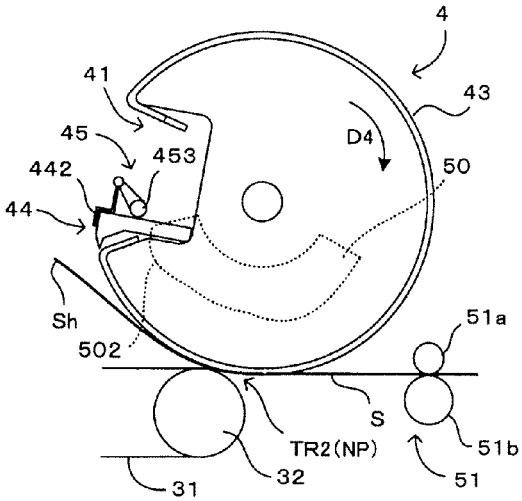

As the aforementioned rotation further progresses, the cam follower 453 comes near the second protrusion 502 of the outer circumference of the cam member 50, as shown in FIG. 8B. As the cam follower 453 moves over the second protrusion 502, the holding part 44 is reopened. After the leading edge Sh of the transfer material S is thus released from the holding state as shown in FIG. 8C, the cam follower 453 and cam member 50 finish making contact with each other, causing to the holding part to close as shown in FIG. 8D. The transfer material S released from the holding state is transported downstream while the transfer material S is urged toward the secondary transfer roller 4 by means of the transport mechanism 6 and blower unit 8 (refer to FIG. 1), and therefore is prevented from tilting toward the intermediate transfer belt 31.

As described above, the present embodiment is configured so that the contact state between the cam follower 453 provided to the secondary transfer roller 4 and the cam member 50 provided to the apparatus housing is varied in accordance with the rotation of the secondary transfer roller 4, thereby opening or closing the holding part 44 to hold or release the transfer material S.

Described below is the operation of the units in a process in which the image forming apparatus thus configured is brought from a stopped state to an image forming operation. First, in the stopped state, it is preferable to position the concave section 41 of the secondary transfer roller 4 at the secondary transfer position TR2 to move the elastic layer 43 away from the intermediate transfer belt 31. This configuration is adopted in order to prevent a permanent deformation of the elastic layer 43 and intermediate transfer belt 31 due to a continuous state of compression between the two.

It is further preferable to rotate the secondary transfer roller 4 for at least one rotation before feeding the transfer material S into the secondary transfer position TR2 when starting the operations of the respective units. A first reason for this is that the position of the leading edge Sh of the transfer material S is synchronized with the rotation phase of the secondary transfer roller 4 as described above. Therefore, synchronization with the rotation phase of the secondary transfer roller 4 must also be maintained in the formation of a toner image in order to align the transfer material S and the toner image to be transferred to the material. Rotating the secondary transfer roller 4 makes it possible to acquire a timing signal related to the rotation phase by means of, e.g., a rotary encoder or a known rotation detecting sensor (not shown).

A second reason is that the present embodiment is configured so that the holding part 44 is opened or closed by the opening/closing mechanism 45 that operates in association with the rotation of the secondary transfer roller 4, as described above. Therefore, the leading edge Sh of the transfer material S is preferably held while the secondary transfer roller 4 is rotated at a predetermined speed in order to hold the leading edge at the correct position.

In this case, the elastic layer 43 of the secondary transfer roller 4 comes into direct contact with the intermediate transfer belt 31 without the interposed transfer material S during the first rotation. In such cases, the problems described below may occur.

Figure 9A:
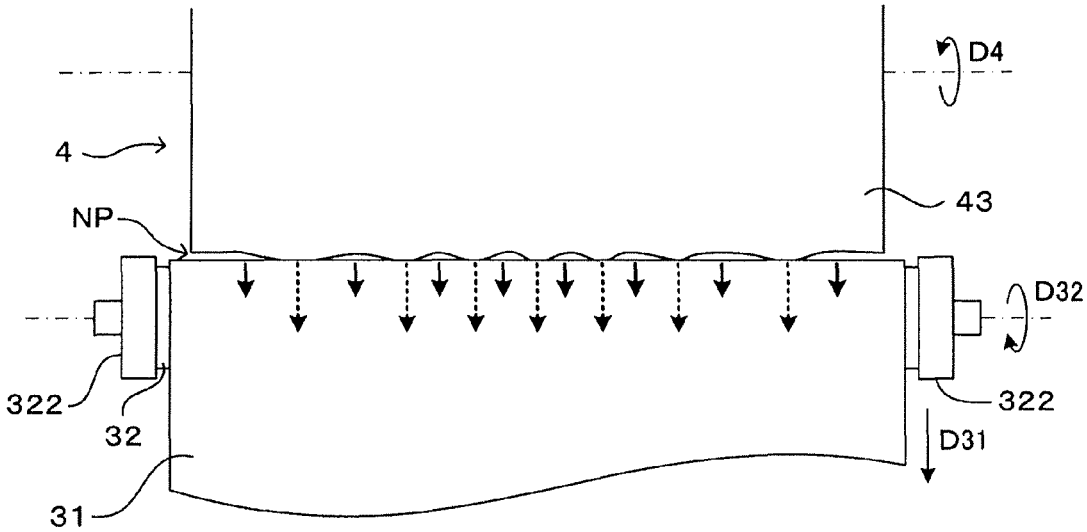
FIG. 9 is a view showing an aspect of deformation of an intermediate transfer belt.

FIG. 9 is a view showing a modified embodiment of an intermediate transfer belt. As described above, in the secondary transfer roller 4 of the present embodiment, the circumferential surface of the approximately cylindrical roller substrate 42 is lined with, for example, with an elastic sheet made of an elastomer to form the elastic layer 43. The end 432 of the elastic layer 43 is held down by the hold-down plate 481, as shown in FIG. 9A. It is still difficult to prevent non-uniform holding pressure from being applied to the hold-down plate 481 in the axial direction of the secondary transfer roller 4 due to, for example, an uneven distribution of fixing positions of the screws 481.

Consequently, ripples may occur on the surface of the elastic layer, particularly at the positions near the end 431 of the elastic layer 43 fixed by the hold-down plate 481, as shown in FIG. 9A. The position near the end 431 of the elastic layer 43 is the position where the secondary transfer roller 4, on which the concave section 41 has been close to the secondary transfer position TR2, first comes into contact the intermediate transfer belt 31 when the secondary transfer roller 4 has started rotating. If ripples occur on the surface of the elastic layer 43 of the secondary transfer roller 4 when the elastic layer 43 comes into contact with the intermediate transfer belt 31, as shown in FIG. 9A, a mixture of regions will be formed in the axial direction of the secondary transfer roller 4 where the elastic layer 43 of the secondary transfer roller 4 comes into contact with the intermediate transfer belt 31 in some regions while contact does not occur in other regions.

Here, it is very difficult in practical terms to perfectly match the movement speed (i.e., the circumferential speed) of the surface of the secondary transfer roller 4, specifically, the surface of the elastic layer 4, and the circumferential speed of the intermediate transfer belt 31 at the secondary transfer position TR2. In other words, a certain difference between the circumferential speeds will inevitably occur between these two components. Consequently, in the nip NP formed by the contact with the elastic layer 43, a slight difference in speeds occurs on the surface of the intermediate transfer belt 31 between the region where the surface comes into contact with the elastic layer 43 of the secondary transfer roller 4, and the region where the contact does not occur. FIG. 9A shows an example in which the circumferential speed of the secondary transfer roller 4 is greater than that of the intermediate transfer belt 31. In this case, the region on the surface of the intermediate transfer belt 31 where the surface comes into contact with the elastic layer 43 travels at a relatively high speed in the circumferential direction, as indicated by the dotted-line arrow shown in FIG. 9A, whereas the region where the surface does not come into contact with the elastic layer 43 has a lower transport speed, as indicated by the solid-line arrow.

Figure 9B:
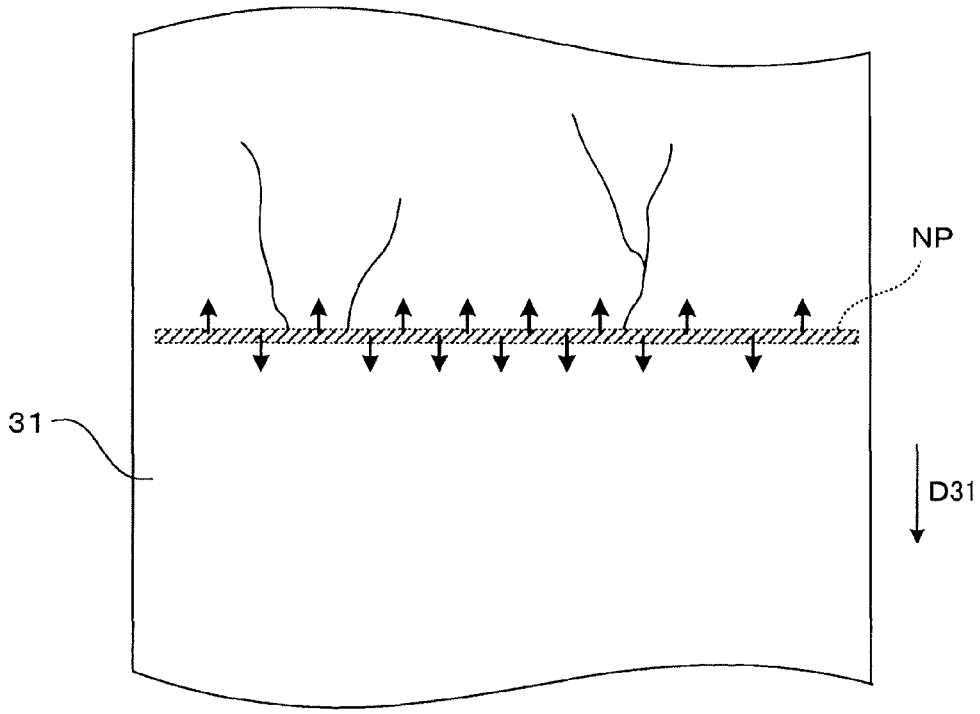

Therefore, tension is applied to the individual positions on the surface of the intermediate transfer belt 31 in the nip NP in directions that are different in different locations, as shown in FIG. 9B, and this causes shearing strain in the intermediate transfer belt 31. An increase in the shearing strain causes unrecoverable deformation in the intermediate transfer belt 31, such as ripples and creases. A high pressure from the secondary transfer roller 4 also increases the deformation. The resulting image distortion cannot be avoided both in the transfer of images from individual image-forming stations to the intermediate transfer belt 31 thus deformed, and in the transfer of images from the intermediate transfer belt 31 to the transfer material S. In other words, such a deformation of the intermediate transfer belt 31 causes image distortion.

Such a deformation of the intermediate transfer belt 31 is significant when a friction force generated between the elastic layer 43 of the secondary transfer roller 4 and the intermediate transfer belt 31 is large; for example, when the elastic layer 43 comes into contact with the intermediate transfer belt 31 in a dry condition. Therefore, the present embodiment is configured so that a liquid component is interposed, and made to function as a lubricant to reduce the coefficient of friction, between the elastic layer 43 of the secondary transfer roller 4 and the intermediate transfer belt 31 when the aforementioned two components first come into contact with each other, thereby preventing the intermediate transfer belt 31 from being deformed by the ripples in the elastic layer 43 and by the difference in speeds between the elastic layer 43 and intermediate transfer belt 31.

More specifically, a liquid developer used as an essential component in the image formation process according to the present embodiment is made to function as a lubricant. Specifically, an operational sequence is executed by the controller 10 so that the surface of the intermediate transfer belt 31 is coated with the liquid developer supplied from one of the image-forming stations 2Y, 2M, 2C, and 2K, and that the elastic layer 43 of the secondary transfer roller 4 is brought into contact with the intermediate transfer belt 31 when the surface region of the intermediate transfer belt 31 coated with the liquid developer is at the secondary transfer position TR2.

Here, in view of the fact that a liquid component is made to function as a lubricant, the liquid developer supplied to the intermediate transfer belt 31 may or may not include the toner. However, to prevent the surface of the intermediate transfer belt 31 (and the elastic layer 43 of the secondary transfer roller 4) from being contaminated, it is preferable to supply the intermediate transfer belt 31 solely with a carrier liquid without a toner component. Accordingly, described below is an operational sequence for supplying the intermediate transfer belt 31 solely with a carrier liquid without a toner component from the liquid developer stored in an image-forming station.

Described herein is the operation for supplying a carrier liquid from the black image-forming station 2K, which is one of the four image-forming stations 2Y, 2M, 2C, and 2K and which is positioned closest to the secondary transfer position TR2. Note that a carrier liquid may be supplied from any of those image-forming stations, or in parallel from a plurality thereof.

Figure 10A:
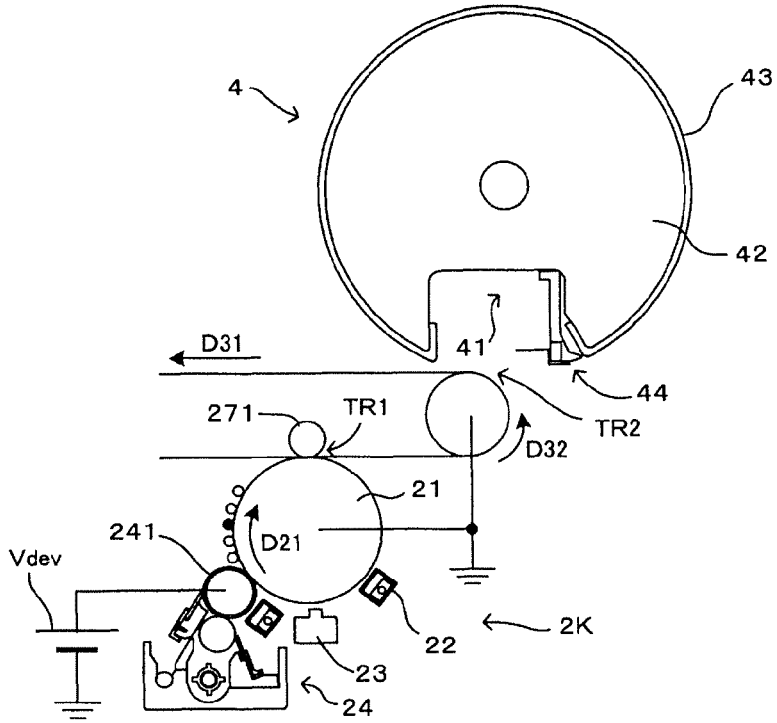
FIG. 10 is a first diagram showing a motion sequence of applying a carrier liquid to the intermediate transfer belt.
Figure 10B:
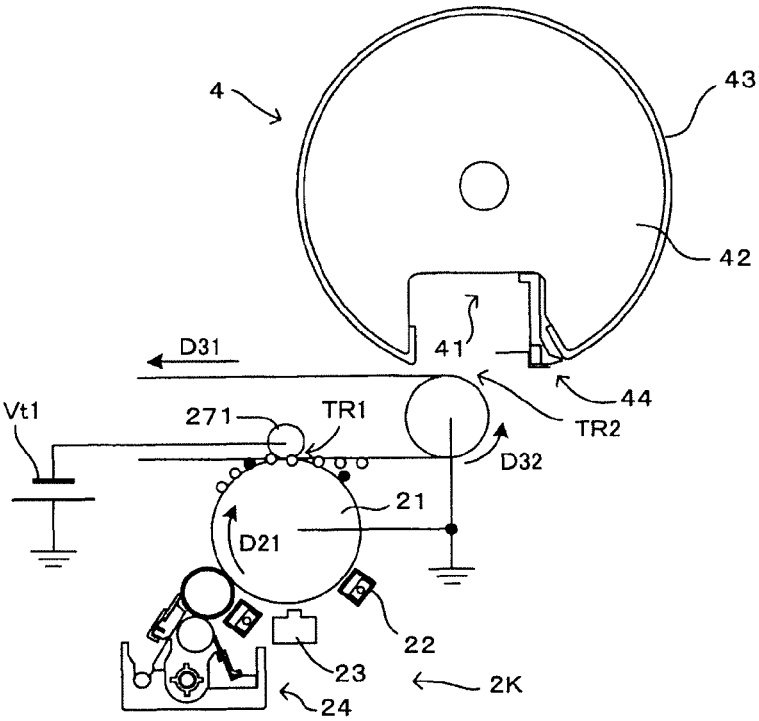
Figure 11A:
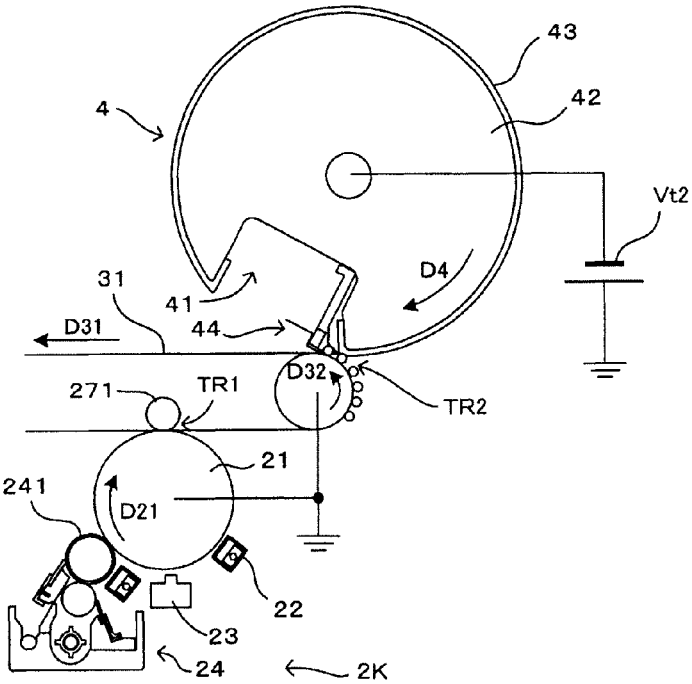
FIG. 11 is a second diagram showing a motion sequence of applying a carrier liquid to the intermediate transfer belt.
Figure 11B:
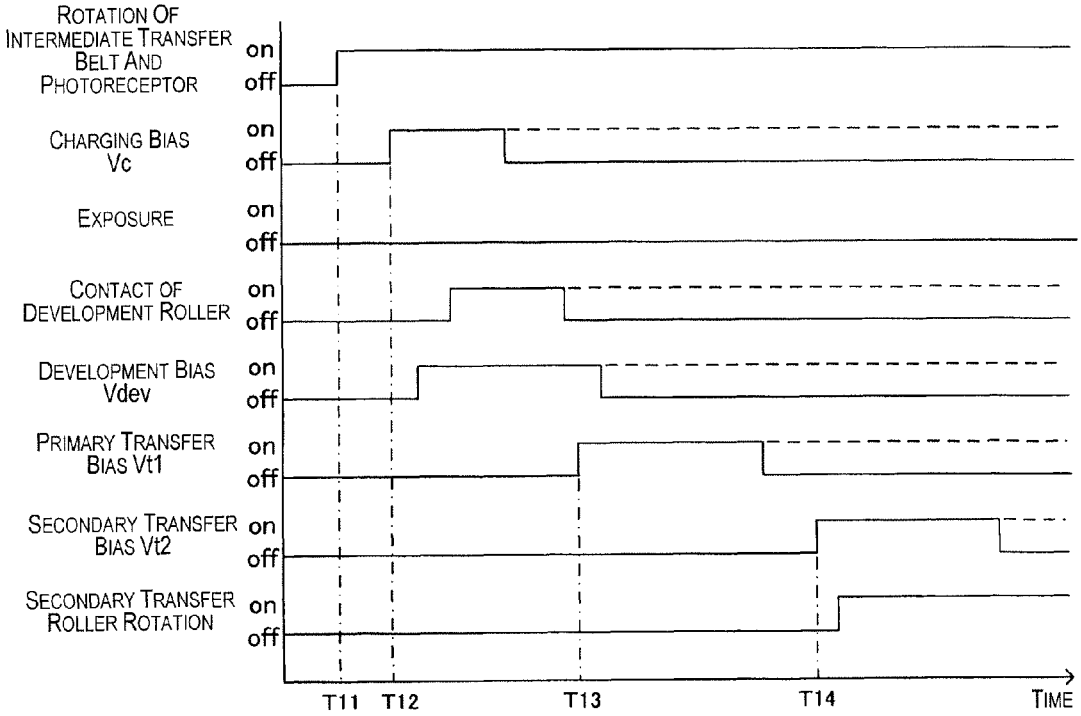

FIGS. 10 and 11 are views showing the operational sequence for supplying the intermediate transfer belt with a carrier liquid. Specifically, FIGS. 10A, 10B, and 11A are views schematically showing the states of individual units in the processes of the operational sequence; and FIG. 11B is a timing chart showing the operational sequence.

As shown in FIG. 10A, first, the carrier liquid (indicated by solid white circles) is supplied to each of the photoreceptor drums 21 from the corresponding developing unit 24, with the secondary transfer roller 4 stopped at a position where the concave section 41 faces the secondary transfer position TR2.

Then, the carrier liquid is primarily transferred to the intermediate transfer belt 31, as shown in FIG. 10B. Then, the elastic layer 43 of the secondary transfer roller 4 is brought into contact with the intermediate transfer belt 31 when the surface region of the intermediate transfer belt 31 coated with the carrier liquid reaches the secondary transfer position TR2, as shown in FIG. 11A.

More specifically, first, the intermediate transfer belt 31 and the photoreceptor drum 21 are rotated as shown in FIG. 11B (Time T11). Then, the charge bias Vc applied to the charger 22 is turned on for a prescribed time from time T12 to charge the photoreceptor drum 21 to a predetermined surface potential. The exposure from the exposure unit 23 is kept at off. An electrostatic latent image equivalent to a highlight image having zero density level (i.e., a so-called white background) is thereby formed on the surface of the photoreceptor drum 21. Then, a predetermined development bias Vdev is applied to the developing roller 241 provided to each of the developing units 24, and the developing roller 241 is brought into contact with the photoreceptor drum 21 at the same time. This causes the latent image on the photoreceptor drum 21 to be developed. The surface potential of the unexposed photoreceptor drum 21 is close to the charge potential, and the absolute value of the surface potential is higher than that of the development bias. Therefore, the developed image is a white background image, and essentially only the carrier liquid is deposited on the photoreceptor drum 21, with a very small amount of background toner (indicated by the solid black circles) deposited thereon. Bringing the developing roller 241 into contact with the photoreceptor drum 21 or moving the roller away from the drum in order to prevent unneeded toner from depositing on the photoreceptor drum 21 is a preferred but not necessary condition. For example, the developing roller 241 may be in continuous contact with the photoreceptor drum 21.

At time T13 when the white background image thus developed is transported to the primary transfer position TR1, a primary transfer bias Vt1 is applied to the backup roller 271. The primary transfer bias Vt1 is a negative voltage having a polarity opposite from the charging polarity (i.e., a positive polarity) of the toner, as shown in FIG. 10B. The background toner deposited on the photoreceptor drum 21 is primarily the toner that is charged to a reverse polarity (i.e., negative polarity). Therefore, application of such a primary transfer bias Vt1 to the backup roller 271 prevents the background toner from being transferred to the intermediate transfer belt 31, and causes only the carrier liquid component, which is not affected by the development bias, to be coated onto the intermediate transfer belt 31.

At time T14 when the surface area of the intermediate transfer belt 31 thus coated with the carrier liquid reaches the secondary transfer position TR2, a secondary transfer bias Vt2 is applied to the secondary transfer roller 4, and rotation of the secondary transfer roller 4 is started simultaneously or with a little delay. This causes the surface of the intermediate transfer belt 31 positioned at the secondary transfer position TR2 to be coated with the carrier liquid when the elastic layer 43 of the secondary transfer roller 4 is brought into contact with the intermediate transfer belt 31. The coefficient of friction between the secondary transfer roller 4 and intermediate transfer belt 31 is reduced by the action of the carrier liquid functioning as a lubricant to prevent the intermediate transfer belt 31 from being deformed by a difference in circumferential speeds and the ripples in the elastic layer 43. Further, the application of a negative voltage as the secondary transfer bias Vt2 to the secondary transfer roller 4 prevents the elastic layer 43 from being contaminated by background toner that is transferred to the elastic layer 43 of the secondary transfer roller 4 from the intermediate transfer belt 31 even if the background toner is deposited thereon. Note that the width of the coated area of the intermediate transfer belt 31 in the movement direction D31 is preferably greater than the nip width Wnp (refer to FIG. 5) in this direction.

The object is to prevent the intermediate transfer belt 31 from being deformed at the initial contact with the elastic layer 43. Therefore, the surface of the intermediate transfer belt 31 in the secondary transfer position TR2 is preferably coated with a liquid component at least during the initial contact between the elastic layer 43 and the intermediate transfer belt 31. Therefore, the period in which the carrier liquid is transferred to the intermediate transfer belt 31 by applying bias voltages to the respective units may be limited as indicated by solid lines shown in FIG. 11B, or the carrier liquid may be continuously coated by continuously applying the bias voltages to the respective units as indicated by the dotted lines.

As described above, the present embodiment is configured so that the surface area of the intermediate transfer belt 31 in an initial contact with the elastic layer 43 is coated in advance with a liquid developer in order to prevent the intermediate transfer belt 31 from being deformed when the elastic layer 43 provided on the surface of the secondary transfer roller 4 comes into contact with the intermediate transfer belt 31 in association with the rotation of the secondary transfer roller 4. The liquid developer is thereby made to function as a lubricant to reduce the coefficient of friction when the elastic layer 43 comes into contact with the intermediate transfer belt 31. It is therefore possible to prevent the intermediate transfer belt 31 from being deformed by the ripples in the elastic layer 43 and the difference in circumferential speed between the secondary transfer roller 4 and the intermediate transfer belt 31. The image supported on the intermediate transfer belt 31 is thereby prevented from being distorted.

Further, the liquid developer to be coated on the intermediate transfer belt 31 is based on the carrier liquid and has a reduced content of the toner component. Contamination of the intermediate transfer belt 31 and the secondary transfer roller 4 by the toner is therefore prevented. The process used when forming a highlight image of zero density level, that is, a so-called white background image, can also be applied as a process for coating a liquid developer devoid of the toner component. Therefore, a specific process is not required to coat the intermediate transfer belt 31 with the liquid developer.

Figure 12:
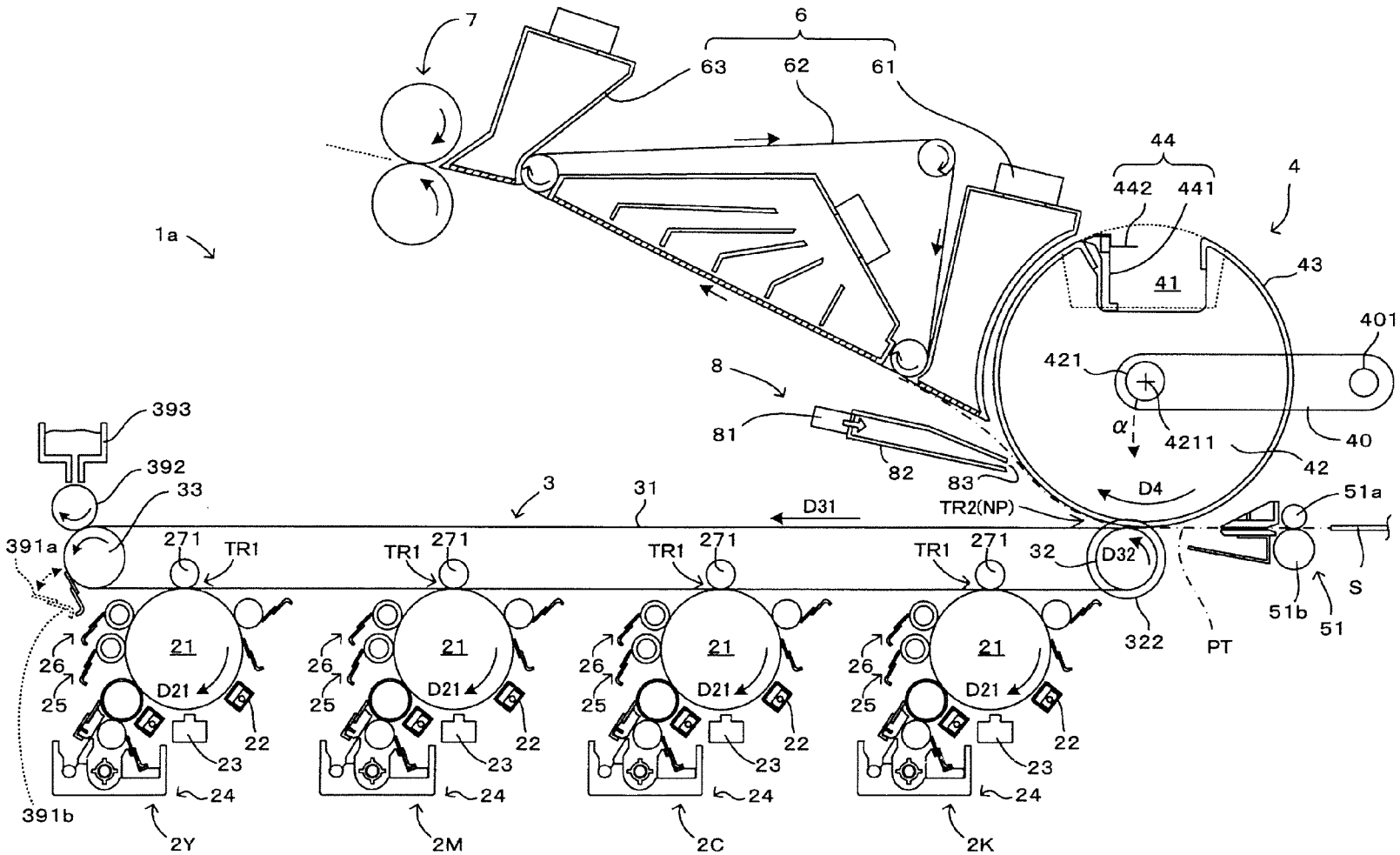
FIG. 12 is a view showing a second embodiment of the image forming apparatus according to the invention.

FIG. 12 is a view showing a second embodiment of the image forming apparatus according to the invention. An image forming apparatus 1*a* of the present embodiment differs from the image forming apparatus 1 of the first embodiment in two respects. First, a cleaner blade 391*a* is configured so as to be able to come into contact with or move away from the intermediate transfer belt 31 by the swing motion of a swinging member 391*b*. Second, there are provided a coating roller 392 in contact with the intermediate transfer belt 31 wound on the roller 33, and a supply unit 393 for supplying the coating roller 392 with the carrier liquid. The first and second embodiments have an otherwise common configuration and function. Accordingly, the same symbols are attached to the same components as those of the first embodiment, and the details are not provided in the following description.

Figure 13A:
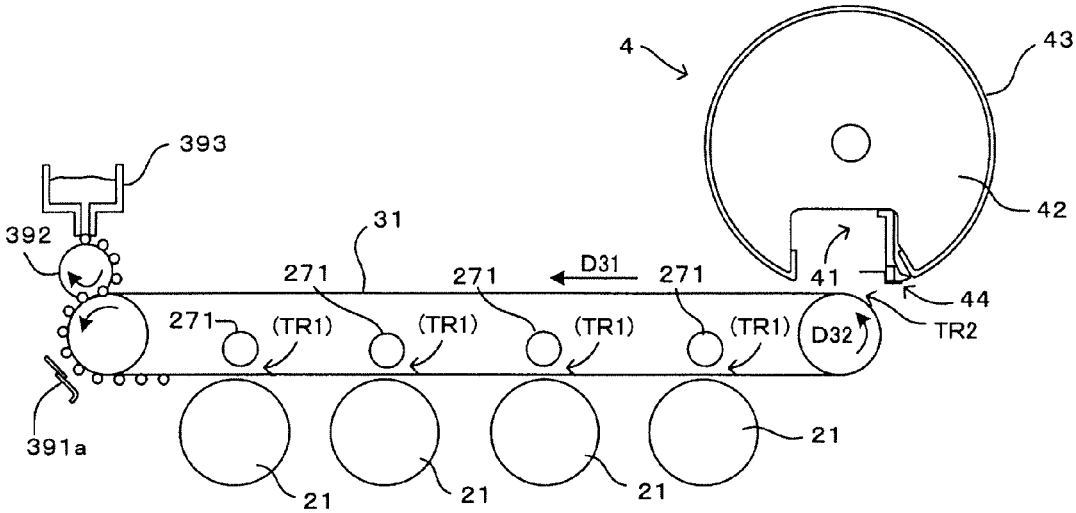
FIG. 13 is a view schematically showing the operational sequence of the second embodiment.
Figure 13B:
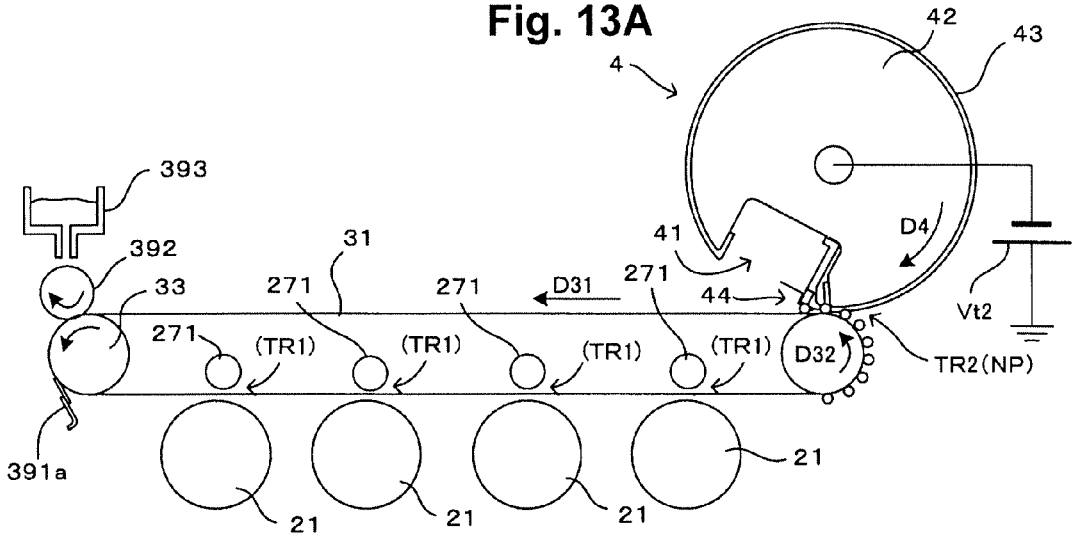

FIG. 13 is a view schematically showing the operational sequence of the second embodiment. In the operational sequence, a carrier liquid (indicated by solid white circles) supplied from the supply unit 393 to the coating roller 392 is coated on the intermediate transfer belt 31, as shown in FIG. 13A. The carrier liquid is prevented from being scraped off by positioning the cleaner blade 391*a* away from the intermediate transfer belt 31. The carrier liquid thus coated on the intermediate transfer belt 31 is transported to the secondary transfer position TR2 in accompaniment with the rotation of the intermediate transfer belt 31. Each photoreceptor drum 21 is preferably positioned in advance away from the intermediate transfer belt 31 in order to prevent the carrier liquid from being transferred to the photoreceptor drum 21. Specifically, the intermediate transfer belt 31 is positioned away from the photoreceptor drum 21 by a process in which the backup roller 271 for pressing the intermediate transfer belt 31 against the photoreceptor drum 21 in the primary transfer position TR1 is retracted in a direction away from the photoreceptor drum 21. Then, the elastic layer 43 of the secondary transfer roller 4 is brought into contact with the intermediate transfer belt 31 when the surface area of the intermediate transfer belt 31 coated with the carrier liquid is in the secondary transfer position TR2 as shown in FIG. 13B, whereby the intermediate transfer belt 31 is prevented from being deformed in the same manner as in the first embodiment.

Figure 14:
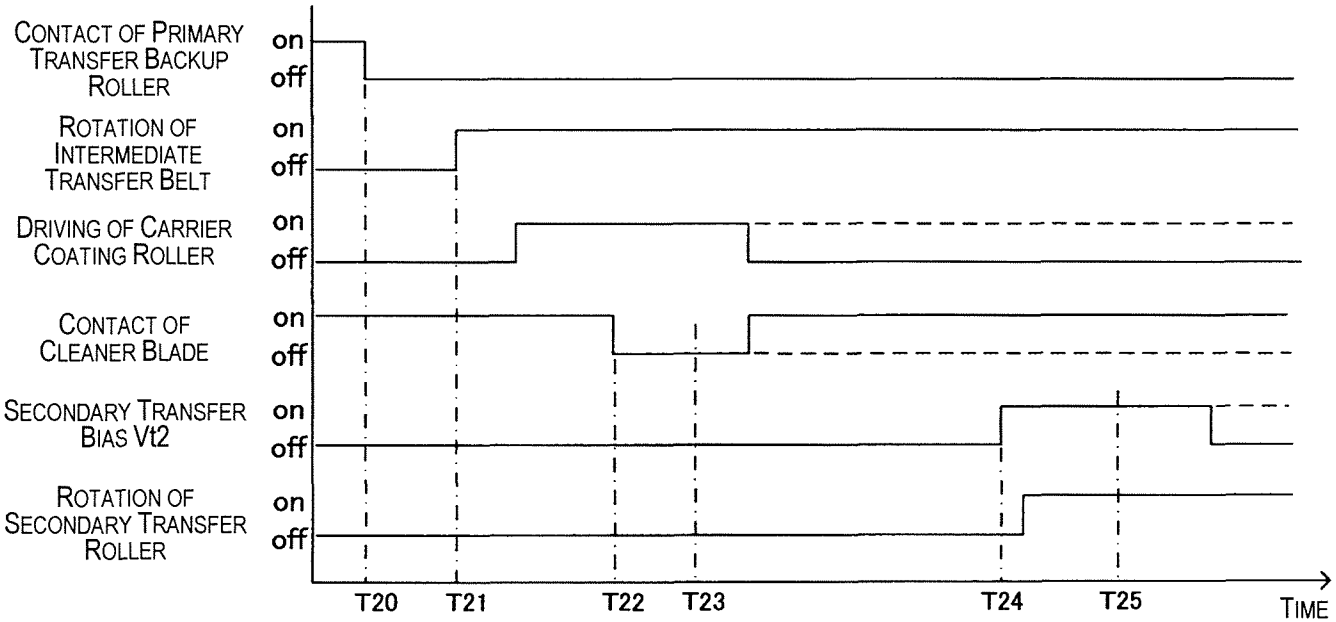
FIG. 14 is a timing chart showing the operational sequence of the second embodiment.

FIG. 14 is a timing chart showing the operational sequence of the second embodiment. At time T20, the intermediate transfer belt 31 is retracted from the photoreceptor drum 21 by retracting the primary transfer backup roller 271. At time T21, rotation of the intermediate transfer belt 31 and the photoreceptor drum 21 is then started, and the coating roller 392 is then rotated. The cleaner blade 391*a* is first brought into contact with the intermediate transfer belt 31. Deposits remaining on the intermediate transfer belt 31 are thereby removed along with the supplied carrier liquid, and the cleaning effect is therefore improved. After a prescribed cleaning time has elapsed, the cleaner blade 391*a* is retracted from the intermediate transfer belt 31 while the carrier liquid is still applied as a coating by the coating roller 392 (time T22). The carrier liquid coated on the intermediate transfer belt 31 is transported downstream without being scraped off by the cleaner blade 391*a*. FIG. 13A shows the state at time T23, which is a little later than time T22.

At time T24 when the surface area of the intermediate transfer belt 31 coated with the carrier liquid reaches the secondary transfer position TR2, the secondary transfer bias Vt2 is applied to the secondary transfer roller 4, and rotation of the secondary transfer roller 4 is started simultaneously or with a little delay. Contact with the elastic layer 43 of the secondary transfer roller 4 is thereby created in a state in which the surface of the intermediate transfer belt 31 in the secondary transfer position TR2 is coated with the carrier liquid. FIG. 13B shows the state at time T25 immediately following the time at which the secondary transfer roller 4 rotates and contact is created between the intermediate transfer belt 31 and the elastic layer 43.

In the present embodiment, as well as in the first embodiment, it is thus possible to prevent the intermediate transfer belt 31 from being deformed by contact with the rippled elastic layer 43, and to prevent the image on the intermediate transfer belt 31 from being distorted by the aforementioned deformation.

As described above, the secondary transfer roller 4 and the intermediate transfer belt 31 in each of the embodiments function as a transfer roller and an image carrier belt, respectively, in accordance with the invention. Further, the controller 10 functions as a control unit according to the invention, and the elastic sheet constituting the elastic layer 43 corresponds to the sheet member according to the invention. Further, the holding part 44 functions as a holding part according to the invention.

The photoreceptor drum 21 and the developing roller 241 in the first embodiment function as a latent image carrier and a developer carrier, respectively, according to the invention. Also in the first embodiment, the exposure unit 23 and the bias generation unit 100 function as an exposure unit and a development bias application unit, respectively, according to the invention. The coating roller 392 and the supply unit 393 in the second embodiment function in integral fashion as a coating unit according to the invention. Further, the cleaner blade 391*a* and the swinging member 391*b* function as a cleaning unit and a moving member, respectively, according to the invention.

The invention is not limited to the above-described embodiments, and various variations and modifications may be possible without departing from the scope of the invention. For example, a sequence that includes turning on the charging of the photoreceptor drum 21, turning off the exposure, turning on the development bias, and turning on the primary transfer bias is performed in the first embodiment when the intermediate transfer belt 31 is supplied with the carrier liquid from the image-forming station 2K. This is an operation designed to form a so-called white background image on the photoreceptor drum 21 and transferring the image to the intermediate transfer belt 31 in order to coat the intermediate transfer belt 31 with the carrier component alone. This is not the only option, however.

Alternatively, a development bias can be applied to the developing roller 241 so that the absolute value of the development bias potential is greater than the absolute value of the surface potential of the exposed region of the photoreceptor drum 21. Under such conditions, the toner is not transferred from the developing roller 241 to the photoreceptor drum 21 regardless of the exposure of the photoreceptor drum 21. Specifically, only the carrier liquid is transferred from the developing roller 241 to the photoreceptor drum 21, and an effect similar to that of the above-described embodiment can be obtained.

The same effect can be obtained by preventing the toner from being transferred from the photoreceptor drum 21 to the intermediate transfer belt 31 in the primary transfer position TR1 even when there has been a transfer of the toner from the developing roller 241 to the photoreceptor drum 21. In order to accomplish this, for example, a positive voltage is applied as the primary transfer bias Vt1 to the primary transfer backup roller 271 so that the charged toner on the photoreceptor drum 21 will not be transferred. This configuration, however, requires that the primary transfer bias has reverse polarity, creating a possibility that the apparatus configuration will be complex, and making a configuration for forming a white background image preferable, as in the embodiment described above.

In addition, the first and second embodiments described above, a carrier liquid that constitutes a liquid developer is used as the coating liquid according to the invention, but the coating liquid is not the only possible option, and other liquids may be used because they function to reduce the coefficient of friction between the elastic layer 43 and intermediate transfer belt 31. In this case, it is possible to prevent the residual coating liquid from having an adverse effect on the subsequent image formation process by removing the coating liquid remaining on the intermediate transfer belt 31 using the cleaner blade 391*a* after the intermediate transfer belt 31 moves past the secondary transfer position TR2.

Furthermore, each of the above-described embodiments refers to an image forming apparatus employing a so-called liquid development system using a developer in which toner is dispersed in a liquid carrier, but the invention is not limited to the aforementioned system. Specifically, regardless of the development system, the invention is applicable to any image forming apparatus including a structure for bringing a transfer roller, which has a concave section on the circumference and which is equipped with a sheet member on the circumference other than the concave section, into contact with an image carrier belt as exemplified in FIG. 1.

General Interpretation of Terms

In understanding the scope of the invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the term's, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the invention, it will be apparent to those skilled in the art from this disclosure that various changes and modifications can be made herein without departing from the scope of the invention as defined in the appended claims. Furthermore, the foregoing descriptions of the embodiments according to the invention are provided for illustration only, and not for the purpose of limiting the invention as defined by the appended claims and their equivalents.

What is claimed is:

1. An image forming apparatus, comprising:

a latent image carrier on which a latent image is formed;

a developer carrier being in contact with the latent image carrier and being configured to develop the latent image formed on the latent image carrier by using a liquid developer that contains toner and a carrier liquid;

an image carrier belt being in contact with the latent image carrier, the latent image carrier being configured to transfer the developed image onto the image carrier belt; and a transfer roller including a sheet member having an inner face, and a concave section on a circumferential surface thereof, the sheet member being arranged on a part of the circumferential surface other than where the concave section is, the transfer roller being configured to transfer the developed image onto a transfer material to be in contact with the transfer material supported at the inner face, the concave section being concaved from the sheet member and extending in a direction towards the center of the transfer roller, the inner face being arranged to an angle with the direction; wherein applying the liquid carrier on a part of the latent image carrier by the developer carrier, contacting the part of the latent image carrier with a part of the image carrier belt and contacting the sheet member with the part of the image carrier belt.

2. The image forming apparatus according to claim 1, further comprising an exposure unit being configured to form the latent image by emitting light to the latent image carrier, wherein the part of the latent image carrier is where the light from the exposure unit is not applied.

3. The image forming apparatus according to claim 1, further comprising an exposure unit being configured to form the latent image by emitting light to the latent image carrier; and a development bias application unit being configured to apply a development bias to the developer carrier, wherein the part of the latent image carrier is where absolute value of a surface potential of the latent image carrier is greater than absolute value of the development bias.

4. The image forming apparatus according to claim 1, wherein the sheet member is made of elastomer or resin.

5. An image forming apparatus, comprising:

an image carrier belt for carrying an image;

a transfer roller including a sheet member having an inner face, and a concave section on a circumferential surface thereof, and a sheet member being configured on a part of the circumferential surface other than where the concave section is, the transfer roller being configured to transfer the developed image onto a transfer material to be in contact with the transfer material supported at the inner face, the concave section being concaved from the sheet member and extending in a direction towards the center of the transfer roller, the inner face being arranged to have an angle with the direction;

a coating unit being configured to coat an part of the image carrier belt with a coating liquid; and a control unit being configured to control the area of the image carrier belt being in contact with the sheet member via the transfer material.

6. The image forming apparatus according to claim 5, further comprising a cleaning unit being configured to clean the image carrier belt by contacting with the image carrier belt; and a moving member being configured to bring the cleaning unit into contact with the image carrier belt; wherein the control unit being configured to move the cleaning unit away from the image carrier belt by using the moving member when performing a drive control so as to bring the area of the image carrier belt in contact with the sheet member via the transfer material.

7. The image forming apparatus according to claim 5, wherein the image carrier belt and the sheet member move away from each other when the transfer roller rotates and the concave section comes to face the image carrier belt.

8. The image forming apparatus according to claim 5, further comprising a gripper being configured on the concave section to grip the transfer material.

9. An image forming method, comprising:

stopping a transfer roller including a sheet member having an inner face, and a concave section on a circumferential surface thereof and a sheet member on a part of the circumferential surface other than where the concave section is, at a position where the concave section faces the image carrier belt with a predetermined distance, the concave section being concaved from the sheet member and extending in a direction towards the center of the transfer roller, the inner face being arranged to have an angle with the direction;

bringing a developer carrier for carrying a liquid developer, which contains toner and a carrier liquid, into contact with a latent image carrier to coat the latent image carrier with the carrier liquid;

bringing the latent image carrier coated with the carrier liquid into contact with the moving image carrier belt to coat the image carrier belt with the carrier liquid;

rotating the transfer roller after the image carrier belt is coated with the carrier liquid;

bringing a transfer material by holding the transfer material at the inner face to an area between the sheet member and the image carrier belt; and bringing the sheet member and the image carrier belt coated with the carrier liquid into contact via the transfer material by rotating the transfer roller.

* * * * *